US009057971B2

(12) United States Patent
Watanabe et al.

(10) Patent No.: US 9,057,971 B2
(45) Date of Patent: Jun. 16, 2015

(54) TONER AND METHOD FOR PRODUCING TONER

(71) Applicant: CANON KABUSHIKI KAISHA, Tokyo (JP)

(72) Inventors: Shuntaro Watanabe, Hadano (JP); Kenji Aoki, Mishima (JP); Toshifumi Mori, Suntou-gun (JP); Atsushi Tani, Suntou-gun (JP); Takaaki Kaya, Suntou-gun (JP); Yoshihiro Nakagawa, Numazu (JP); Tetsuya Kinumatsu, Numazu (JP); Takashige Kasuya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/905,584

(22) Filed: May 30, 2013

(65) Prior Publication Data

US 2013/0323637 A1 Dec. 5, 2013

(30) Foreign Application Priority Data

Jun. 1, 2012 (WO) ..... PCT/JP2012/064315

(51) Int. Cl.
*G03G 9/087* (2006.01)
*G03G 9/093* (2006.01)
*G03G 9/08* (2006.01)

(52) U.S. Cl.
CPC ..... *G03G 9/08755* (2013.01); *G03G 9/0802* (2013.01); *G03G 9/0804* (2013.01); *G03G 9/0821* (2013.01); *G03G 9/08722* (2013.01); *G03G 9/08764* (2013.01); *G03G 9/08773* (2013.01); *G03G 9/08788* (2013.01); *G03G 9/08797* (2013.01); *G03G 9/09328* (2013.01); *G03G 9/09371* (2013.01)

(58) Field of Classification Search
CPC ..... G03G 9/08755; G03G 9/08797; G03G 9/08795; G03G 9/0825; G03G 9/0819
USPC ..... 430/110.2, 109.4
See application file for complete search history.

(56) References Cited

U.S. PATENT DOCUMENTS

| | | | | |
|---|---|---|---|---|
| 2008/0247788 | A1* | 10/2008 | Ayaki et al. | 399/321 |
| 2012/0231383 | A1* | 9/2012 | Santo et al. | 430/105 |
| 2012/0231389 | A1* | 9/2012 | Matsuoka et al. | 430/109.2 |
| 2012/0237868 | A1* | 9/2012 | Yamada et al. | 430/108.21 |
| 2012/0251941 | A1* | 10/2012 | Fujii et al. | 430/111.4 |

(Continued)

FOREIGN PATENT DOCUMENTS

| | | | |
|---|---|---|---|
| JP | 2006-337751 | A | 12/2006 |
| JP | 2007-277511 | A | 10/2007 |

(Continued)

*Primary Examiner* — Hoa V Le
(74) *Attorney, Agent, or Firm* — Canon U.S.A. Inc., IP Division

(57) ABSTRACT

Provided is a toner that is excellent in terms of low-temperature fixability and hot offset resistance, has a wide fixing temperature range from a low-temperature region to a high-temperature region, and has high thermal storability.
When the toner is measured with a capillary rheometer, t(1) is 60 seconds or more and t(5) is 30 seconds or less and the toner satisfies the following formulae (1) and (2)

$$65.0[^\circ\,C.] \leq T(5) \leq 90.0[^\circ\,C.] \quad (1)$$

$$4.5 \leq t(1)/t(5) \leq 10.0 \quad (2).$$

12 Claims, 4 Drawing Sheets

(56) References Cited

U.S. PATENT DOCUMENTS

| | | | | |
|---|---|---|---|---|
| 2012/0258392 | A1* | 10/2012 | Murata et al. | 430/105 |
| 2012/0264041 | A1* | 10/2012 | Yamasaki et al. | 430/105 |
| 2012/0295193 | A1* | 11/2012 | Hanatani et al. | 430/109.4 |
| 2013/0059247 | A1* | 3/2013 | Sugimoto et al. | 430/109.4 |

FOREIGN PATENT DOCUMENTS

| | | | |
|---|---|---|---|
| JP | 2008-287088 | A | 11/2008 |
| JP | 2009-122687 | A | 6/2009 |
| JP | 2009-294655 | A | 12/2009 |
| JP | 2010-055094 | A | 3/2010 |
| JP | 2010-60651 | A | 3/2010 |
| JP | 2010-150535 | A | 7/2010 |
| JP | 2010-175933 | A | 8/2010 |
| JP | 2011-94135 | A | 5/2011 |
| JP | 2011-232738 | A | 11/2011 |
| WO | 2011/152008 | A1 | 12/2011 |

* cited by examiner

TONER AND METHOD FOR PRODUCING TONER

TECHNICAL FIELD

The present invention relates to a toner used in an image-forming method employing an electrophotographic process, an electrostatic recording process, or a toner-jet recording process; and a method for producing the toner.

BACKGROUND ART

In recent years, energy conservation has been considered as a significant technical objective even in the fields of electrophotographic apparatuses such as copiers and printers. In order to achieve the objective, considerable reduction of the amount of heat used in fixing devices has been demanded. For this reason, there has been a demand for toners that are fixable with a small amount of heat, that is, toners having a good low-temperature fixability.

In addition, there has been a strong need for high-speed printing. When continuous printing for a large number of sheets is performed at a high speed, heavy load is applied to the toner due to the toner being rubbed against members constituting a development device and the toner tends to become degraded. The degraded toner causes contamination of the members, which may cause degradation of chargeability or image defects such as development streaks. Accordingly, there has been a demand for a toner having enhanced stress resistance to suppress degradation of the toner.

In order to provide a toner having both low-temperature fixability and stress resistance, the toner desirably has the following characteristics: the toner easily deforms under a pressure load during fixing, but has a sufficiently high strength against a relatively light pressure load.

An effective known method of achieving fixing at a lower temperature is to use a binder resin that contains a component having a crystalline structure.

Crystalline polyester has molecular chains that are regularly arranged and, as a result, does not clearly undergo glass transition, does not soften in a temperature range lower than the crystalline melting point, but melts at a temperature slightly higher than the melting point. Crystalline polyester thus has what is called a sharp melting characteristic.

In view of this feature, toners containing crystalline polyester as a component having a crystalline structure have been studied.

Patent Literature 1 proposes a toner including, as a binder resin, a block polymer including, in a crystalline segment, a crystalline polyester component or a crystalline polyurethane component and, in an amorphous segment, an amorphous polyester component or an amorphous polyurethane component.

Use of such a block polymer as a binder resin can impart the sharp melting characteristic to the toner. However, amorphous resin films (shells) formed in the surfaces tend to cause loss of the sharp melting characteristic of the toner on the whole. Thus, it was found that the low-temperature fixability needs to be improved.

Patent Literature 2 proposes a toner including, as a shell material, a crystalline resin prepared from a monomer including a long chain alkyl group or a crystalline polyester chain. However, when the crystalline resin is used as a shell material alone, the low-temperature fixability is not sufficiently improved and the low-temperature fixability needs to be improved.

Thus, in a toner having a core-shell structure, use of resins having a crystalline structure as both of the core material and the shell material was considered to improve the low-temperature fixability.

Patent Literature 3 proposes a toner including, as a core material, a block polymer including a crystalline segment and an amorphous segment bonded together and, as a shell material, a resin including a crystalline polyester chain.

According to this method, the toner has an enhanced sharp melting characteristic. However, the following has been found: the crystalline polyester does not necessarily have sufficient stress resistance; when the crystalline polyester segment is present in a large quantity in the toner surface, toner deformation is caused in a development device during continuous printing for a large number of sheets and image defects such as development streaks tend to be caused.

Patent Literature 4 proposes a toner including, as a core material, a resin containing a block polymer including a crystalline polyester and an amorphous polyester. In this literature, this block polymer is used as the shell material to produce the toner having a core-shell structure. It is alleged that press fixing of this toner is allowed by using plastic behavior of the polyester block polymer under the application of a certain pressure or more and the toner can have high toner strength in a development device. The inventors of the present invention produced this toner and evaluated fixability with a standard film-fixing fixing device. However, sufficient fixability was not achieved. Accordingly, such a toner still needs to be improved in terms of achieving both sharp melting characteristic and low-temperature fixability.

As described above, in order to achieve a toner having both low-temperature fixability and stress resistance, a toner to which a component having a crystalline structure has been introduced still needs to be improved.

CITATION LIST

Patent Literature

PTL 1: International Publication No. 2009-122687
PTL 2: Japanese Patent Laid-Open No. 2010-150535
PTL 3: Japanese Patent Laid-Open No. 2011-94135
PTL 4: Japanese Patent Laid-Open No. 2010-60651

The present invention is directed to providing a toner having both low-temperature fixability and stress resistance. Further, the present invention is directed to providing a method for producing the toner.

SUMMARY OF INVENTION

According to one aspect of the present invention, there is provided a toner including toner particles, each of which contains a binder resin and a colorant, wherein, in a rheological property measurement of the toner with a constant load extrusion-type capillary rheometer provided with a piston for applying a pressure to a sample and a die having a die orifice through which the sample is extruded, wherein the piston has a pressure-application surface area of 1.0 $cm^2$ and the die orifice has a diameter of 1.0 mm, when a pressure of 5.0 MPa is applied to the sample with the piston, a temperature at which a displacement of the piston reaches 2.0 mm after 10 seconds from initiation of an application of the pressure is defined as T(5) [° C.]; when a pressure of 1.0 MPa is applied to the sample with the piston under heating at 70° C., a time over which a displacement of the piston reaches 2.0 mm from initiation of the pressure application is defined as t(1) [s]; when a pressure of 5.0 MPa is applied to the sample with the piston under heating at 70° C., a time over which a displacement of the piston reaches 2.0 mm from initiation of the pressure application is defined as t(5) [s], T(5) is 65.0° C. or more and 90.0° C. or less, t(1) is 60.0 seconds or more, t(5) is 30.0 seconds or less, and t(1)/t(5) is 4.5 or more and 10.0 or less.

According to another aspect of the present invention, there is provided a method for producing a toner in which toner particles are produced by (I) a step of obtaining a resin composition in which a binder resin and a colorant are dissolved or dispersed in a medium containing an organic solvent, (II) a step of obtaining a dispersion by dispersing the resin composition in a dispersion medium containing resin fine particles containing a resin B for forming a shell phase and carbon dioxide that is at a pressure of 1.0 MPa or more and 20.0 MPa or less and at a temperature of 10° C. or more and 40° C. or less, and (III) a step of removing the organic solvent from the dispersion, wherein the produced toner contains the toner particles, each of which contains the binder resin and the colorant, in a rheological property measurement of the toner with a constant load extrusion-type capillary rheometer provided with a piston for applying a pressure to a sample and a die having a die orifice through which the sample is extruded, wherein the piston has a pressure-application surface area of 1.0 $cm^2$ and the die orifice has a diameter of 1.0 mm, when a pressure of 5.0 MPa is applied to the sample with the piston, a temperature at which a displacement of the piston reaches 2.0 mm after 10 seconds from initiation of an application of the pressure is defined as T(5) [° C.]; when a pressure of 1.0 MPa is applied to the sample with the piston under heating at 70° C., a time over which a displacement of the piston reaches 2.0 mm from initiation of the pressure application is defined as t(1) [s]; when a pressure of 5.0 MPa is applied to the sample with the piston under heating at 70° C., a time over which a displacement of the piston reaches 2.0 mm from initiation of the pressure application is defined as t(5) [s], T(5) is 65.0° C. or more and 90.0° C. or less, t(1) is 60.0 seconds or more, t(5) is 30.0 seconds or less, and t(1)/t(5) is 4.5 or more and 10.0 or less.

Further features of the present invention will become apparent from the following description of exemplary embodiments with reference to the attached drawings.

DESCRIPTION OF EMBODIMENTS

Figure 1:
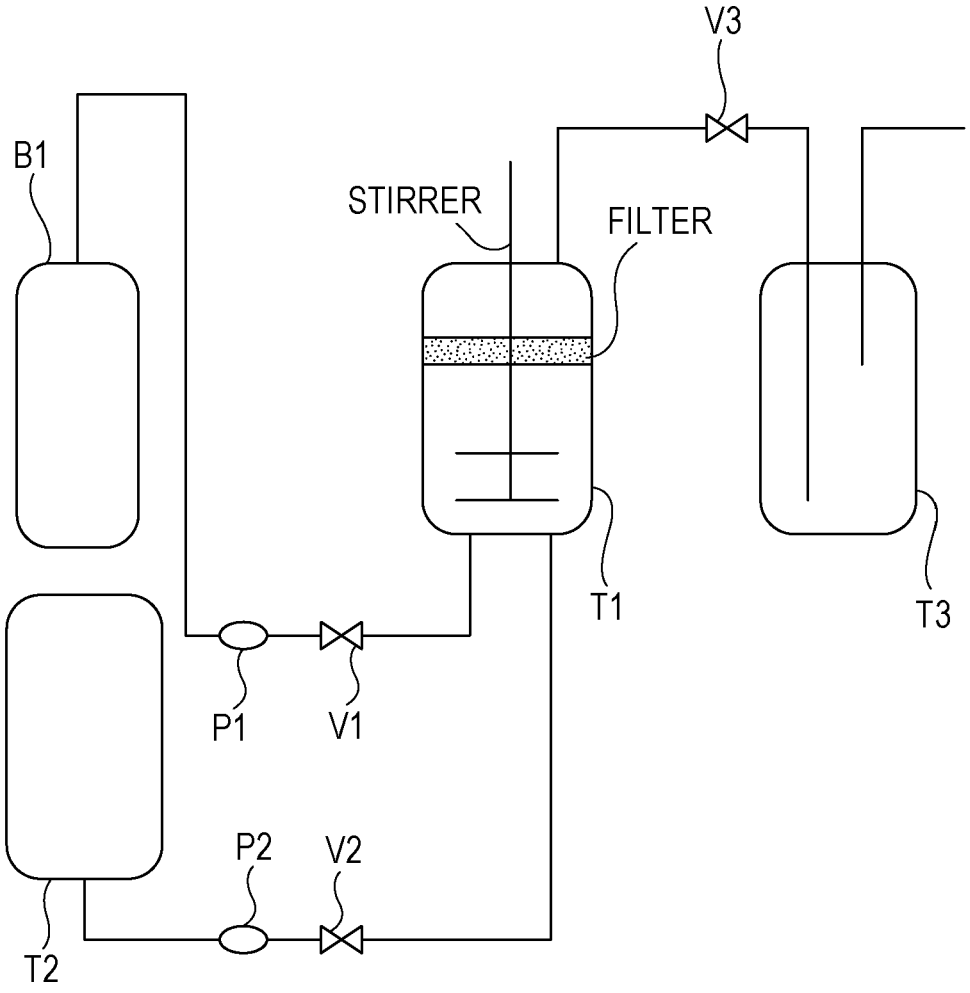
FIG. 1 is a schematic view of an apparatus for producing a toner.

Hereinafter, a toner according to the present invention will be described.

As described in the Background Art, the introduction of a component having a crystalline structure allows production of a toner that is excellent in terms of the sharp melting characteristic. However, this sharp melting characteristic represents the behavior of a toner in which a rise in the heating temperature results in the initiation of melting of the toner.

The fixing step in the electrophotographic process is performed by applying heat and pressure to a toner for a very short time to fix the toner on a transfer material. Accordingly, the toner melting behavior needs to be observed in additional consideration of the time factor.

Indices used for evaluation of the sharp melting characteristic of a toner have been a softening point, a melt viscosity, a storage elastic modulus, and a loss elastic modulus. However, these characteristic values do not sufficiently reflect the time factor. In addition, these characteristic values are measured by a method in which the measurement is initiated after a sufficiently large amount of heat is applied or a method in which the measurement is performed with a gradual rise in the temperature from a low temperature; accordingly, it is difficult to observe the toner behavior in the initial stage of heating.

The inventors of the present invention regard, as the melting rate of a toner, a rate at which the toner starts moving in the initial stage of application of heat and pressure. The inventors adjust measurement conditions for a constant load extrusion-type capillary rheometer and the melting rate of a toner is measured in additional consideration of the time factor. Hereinafter, this measurement will be described. Note that details of the measurement method will be described below.

The melting rate of a toner is measured with a constant load extrusion-type capillary rheometer "rheological property evaluation instrument Flowtester CFT-500D" (manufactured by SHIMADZU CORPORATION) in accordance with a manual supplied with the instrument. In this instrument, while a constant pressure is applied with a piston onto a measurement sample charged into a cylinder, the measurement sample within the cylinder is heated to melt and the melted measurement sample is extruded through a die orifice in a bottom portion of the cylinder; at this time, a flow curve representing the relationship between temperature or time and downward displacement of piston (displacement) can be obtained.

Test modes with the capillary rheometer are a temperature rising method in which the measurement is performed with a temperature rising at a constant rate, which is generally commonly used in the field of toners, and a constant temperature method in which the measurement is performed under constant temperature conditions. In the present invention, the constant temperature method is employed. In a standard constant temperature method, a measurement sample is charged into a cylinder having been heated to a target temperature and then is preheated for about 3 to about 5 minutes. This preheating provides a state in which the sample has been sufficiently melted and the measurement is initiated. Thus, a flow curve is obtained from time and downward displacement of piston (displacement). Specifically, this method is used to determine the melt viscosity of a measurement sample under constant temperature conditions; since the sample has been heated by preheating prior to the measurement, the toner behavior in the initial stage of the actual fixing step is not sufficiently reproduced. On the other hand, in the present invention, in order to minimize the influence of the preheating on the toner, the time from the charging of the sample to the initiation of the measurement is set to be 15 seconds. As a result, the melting rate of the measurement sample can be measured over the time from the application of heat to the sample to the initiation of melting of the sample.

In summary, reduction of the time of preheating as much as possible allows the measurement of a characteristic value that corresponds to the toner behavior under conditions of pressure application and heating for a short period of time in the actual fixing step.

As described above, even when a component having a crystalline structure is introduced to the core material and the shell material constituting a toner to merely impart the sharp melting characteristic, it is difficult to maintain the stress resistance of the toner. In order to achieve both low-temperature fixability and stress resistance, technical improvements need to be performed such that a toner exhibits a high melting rate under a relatively high pressure condition as in the fixing step, and the toner is less likely to soften under a relatively low pressure condition in the case of being rubbed against members constituting a development device.

The inventors of the present invention studied the correlation between the state of a fixing step in a high speed printer and the constant temperature method with a capillary rheometer under various conditions.

When the process speed of a fixing step in a high speed printer is considered as about 200 mm/s to about 350 mm/s and the nip width is about 5.0 mm to about 15.0 mm, the time over which a transfer material passes through the fixing nip region is about 15 milliseconds to about 75 milliseconds. In addition, in general, the thickness of a toner layer on a transfer material is about 5 μm to about 20 μm; a preferred manner in which the toner of a toner layer having such a thickness is melted and deformed during the above-described pass-through time was studied.

As a result of the studies, the inventors of the present invention have found that a toner exhibiting excellent melting characteristics during fixing can be defined with, in a measurement with the capillary rheometer, a temperature at which a pressure of 5.0 MPa is applied to a toner with the piston and a displacement of the piston reaches 2.0 mm after 10 seconds from initiation of the pressure application. That is, the inventors of the present invention have found that, when this temperature is within a specific range, a toner layer placed on a transfer material is sufficiently compressed, deformed, and melted to be fixed on the transfer material within the time over which the transfer material passes through a fixing device.

In the present invention, in a measurement with a constant load extrusion-type capillary rheometer provided with a piston for applying a pressure to a sample and a die having a die orifice through which the sample is extruded, the piston having a pressure-application surface area of 1.0 $cm^2$ and the die orifice having a diameter of 1.0 mm, when a pressure of 5.0 MPa is applied to a toner with the piston, a temperature T(5) [° C.] at which a displacement of the piston reaches 2.0 mm after 10 seconds from initiation of an application of the pressure satisfies the following formula (1).

$$65.0[°\,C.] \leq T(5) \leq 90.0[°\,C.] \quad (1)$$

When a toner satisfies the requirement of the formula (1), the toner can have both low-temperature fixability and thermal storability. When T(5) is less than 65.0° C., the toner tends to have poor thermal storability. When T(5) is more than 90.0° C., the toner tends to have poor low-temperature fixability.

In the measurement with a capillary rheometer, when a pressure of 5.0 MPa is applied to the sample with the piston under heating at 70° C. and a time over which a displacement of the piston reaches 2.0 mm is defined as t(5) [s], t(5) is 30.0 s or less in a toner according to the present invention.

In the fixing step with a high speed printer, when fixing is performed such that the temperature of the contact surface of a fixing member with a transfer material is about 100° C., the actual temperature of the toner is probably about 70° C. That is, when the value of t(5) is 30.0 s or less and the value of T(5) satisfies the formula (1) above, fixing with a fixing member having a surface temperature of about 100° C. can be achieved. Note that, from the requirement of t(1)/t(5) described below, the lower limit of the value of t(5) is 6.0 s.

When the value of T(5) is 90.0° C. or less and the value of t(5) is 30.0 s or less, the toner can have sufficient low-temperature fixability.

In addition, the inventors of the present invention also studied the correlation between stress resistance and melting rate of toner.

In the capillary rheometer, when a pressure of 1.0 MPa is applied to the toner with the piston under heating at 70° C., a time over which a displacement of the piston reaches 2.0 mm is defined as t(1) [s].

When a toner is rubbed against a member within a development device, the energy of pressure and rubbing probably causes a rise in the toner temperature to about 50° C. to about 60° C. Accordingly, when a toner is deformed and flows in a measurement with the capillary rheometer at 70° C. under the application of a pressure of about 1.0 MPa, the toner does not have sufficient stress resistance at all. The inventors of the present invention performed studies and, as a result, have found that there is a correlation between the value of t(1) and the stress resistance of a toner.

In a toner according to the present invention, the value of t(1) is 60.0 seconds or more. In the case where t(1) is less than 60.0 seconds, when the toner is rubbed within a development device, the toner surface is softened and easily adheres to a regulation member or a carrier, causing image defects such as development streaks or charging failure. Note that, from the requirement of t(1)/t(5) described below, the upper limit of the value of t(1) is 300.0 seconds.

In addition, the inventors of the present invention have also found that achievement of both low-temperature fixability and stress resistance in a toner requires that t(1) and t(5) described above satisfy a specific relationship.

Specifically, a toner according to the present invention is required that t(1) and t(5) described above satisfy the relationship of the following formula (2).

$$4.5 \leq t(1)/t(5) \leq 10.0 \quad (2)$$

When this relationship is satisfied, the toner is easily melted under the pressure of a fixing device in the fixing step so that the low-temperature fixability is sufficiently ensured, whereas softening of the toner surface is suppressed under the application of a relatively low pressure. That is, when t(1)/t(5) is less than 4.5 and T(5) satisfies the formula (1), the stress resistance of the toner is insufficient and the toner surface tends to soften even under the application of a low pressure. It is difficult to design a toner such that T(5) satisfies the range of the formula (1) and t(1)/t(5) is more than 10.0, and the toner has a poor low-temperature fixability.

In a measurement of a toner according to the present invention with a differential scanning calorimeter (DSC), a peak temperature Tp (° C.) of a maximum endothermic peak is preferably 55.0° C. or more and 75.0° C. or less, more preferably 55.0° C. or more and 70.0° C. or less.

When Tp is 55.0° C. or more, the toner has a further enhanced thermal storability. When Tp is 75.0° C. or less, the low-temperature fixability is easily ensured in the toner. In addition, when Tp is within such a range, the value of T(5) tends to satisfy the formula (1) above.

A toner according to the present invention includes toner particles, each of which contains a binder resin and a colorant. Each of the toner particles preferably has a core-shell structure in which a shell phase containing a resin B is formed on the surface of a core containing a binder resin A, a colorant, and a wax. In the core-shell structure in the present invention, the shell phase does not necessarily completely cover the surface of the core and the core-shell structure also encompasses a configuration in which the core is partially exposed. The core-shell structure also encompasses a configuration in which a shell phase that is a layer having a clear interface does not cover the core but a shell phase covers the core without a clear interface. By forming a core-shell structure, design of a toner in which t(1) and t(5) satisfy the relationship of the formula (2) above is facilitated and the toner can have both stress resistance and low-temperature fixability.

In addition, the tetrahydrofuran- (THF-) soluble matter of the toner measured by gel permeation chromatography (GPC) preferably has a number-average molecular weight (Mn) of 5,000 or more and 40,000 or less, more preferably 7,000 or more and 25,000 or less; and a weight-average molecular weight (Mw) of 5,000 or more and 60,000 or less, more preferably 10,000 or more and 50,000 or less. When such a range is satisfied, a high thermal storability can be maintained and, in addition, the toner can have a proper sharp melting characteristic.

Hereinafter, the configuration of a toner and a method for producing the toner for satisfying the above-described features in the present invention will be described. However, the present invention is not necessarily limited to this configuration of a toner and this method for producing the toner.

Binder Resin

Each of the toner particles contains a binder resin and a colorant. Examples of the binder resin include vinyl-based resins and polyester-based resins that are publicly known as binder resins for toners.

As described above, the toner particles preferably have a core-shell structure in which a shell phase containing a resin B is formed on the surface of a core containing a binder resin A, a colorant, and a wax.

The binder resin A preferably contains a resin having a segment capable of forming a crystalline structure. In addition, the segment capable of forming a crystalline structure is preferably a polyester segment.

In the binder resin A, the content of the polyester segment capable of forming a crystalline structure is preferably 50.0% by mass or more and 90.0% by mass or less.

When the content of a segment capable of forming a crystalline structure in the binder resin A is within the above-described range, the sharp melting characteristic can be further enhanced and the low-temperature fixability can be further improved.

In addition, in a measurement of the binder resin A with a differential scanning calorimeter (DSC), a peak temperature TpA of a maximum endothermic peak derived from a segment capable of forming a crystalline structure is preferably 55.0° C. or more and 75.0° C. or less. When TpA is within this range, the thermal storability and the low-temperature fixability can be further enhanced.

When the segment capable of forming a crystalline structure is a crystalline polyester, this is preferably synthesized from starting materials of an aliphatic diol and a polycarboxylic acid.

The aliphatic diol is preferably a linear aliphatic diol having 4 or more and 20 or less carbons and examples thereof are as follows:

1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. These may be used alone or in combination of two or more thereof.

Of these, in view of the melting points suitable for low-temperature fixability, 1,4-butanediol, 1,5-pentanediol, and 1,6-hexanediol are more preferred in the present invention.

The polycarboxylic acids are preferably aromatic dicarboxylic acids and aliphatic dicarboxylic acids. Of these, more preferred are aliphatic dicarboxylic acids and, in particular, preferred are linear aliphatic dicarboxylic acids.

Non-limiting examples of the linear aliphatic dicarboxylic acids are as follows:

oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, lower alkyl esters of the foregoing, and anhydrides of the foregoing. These may be used alone or in combination of two or more thereof.

Examples of the aromatic dicarboxylic acids are as follows:

terephthalic acid, isophthalic acid, 2,6-naphthalenedicarboxylic acid, and 4,4'-biphenyldicarboxylic acid.

Of these, in view of the melting points suitable for low-temperature fixability, adipic acid, sebacic acid, and 1,10-decanedicarboxylic acid are preferred in the present invention.

The method for producing the crystalline polyester component is not particularly limited. The crystalline polyester component can be produced by a standard polyester resin polymerization method of causing a reaction between an alcohol component and an acid component. For example, direct polycondensation or transesterification can be selected in accordance with the type of a diol or the type of a dicarboxylic acid.

The crystalline polyester component is preferably produced at a polymerization temperature of 180° C. or more and 230° C. or less; if necessary, the pressure of the reaction system is preferably reduced so that the reaction proceeds while water or alcohol generated during condensation is removed. When monomers are not soluble or miscible at a reaction temperature, the monomers are preferably dissolved by adding a solvent having a high boiling point as a solubilizing agent. A polycondensation reaction proceeds while the solubilizing solvent is evaporated. In a copolymerization reaction in which a monomer having a low miscibility is present, the monomer having a low miscibility and an acid or alcohol that is subjected to polycondensation with the monomer are preferably condensed in advance and are subjected to polycondensation with a main component.

When the crystalline polyester component contained in the molecular structure of the binder resin A is measured with a differential scanning calorimeter (DSC), the peak temperature of a maximum endothermic peak is preferably 55.0° C. or more and 80.0° C. or less.

The tetrahydrofuran- (THF-) soluble matter of the crystalline polyester component contained in the molecular structure of the binder resin A, measured by gel permeation chromatography (GPC) preferably has a number-average molecular weight (Mn) of 3,000 or more and 40,000 or less, more preferably 7,000 or more and 25,000 or less; and a weight-average molecular weight (Mw) of 10,000 or more and 60,000 or less, more preferably 20,000 or more and 50,000 or less. When such a range is satisfied, a high thermal storability can be maintained and, in addition, the toner can have a sharp melting characteristic.

Examples of a catalyst usable for the production of the crystalline polyester component are as follows:

titanium catalysts that are titanium tetraethoxide, titanium tetrapropoxide, titanium tetraisopropoxide, and titanium tetrabutoxide; and tin catalysts that are dibutyl tin dichloride, dibutyl tin oxide, and diphenyl tin oxide.

In a toner according to the present invention, the binder resin A may contain, in addition to the resin having a segment capable of forming a crystalline structure, an amorphous resin.

Non-limiting examples of the amorphous resin used for the binder resin A include polyurethane resins, polyester resins, and vinyl-based resins (styrene acrylic resins and polystyrene). These resins may be modified with urethane, urea, or epoxy. In the present invention, when the binder resin A contains the amorphous resin, the elasticity can be maintained after the segment capable of forming a crystalline structure is melted. In particular, polyester resins and polyurethane resins are preferably used.

A polyester resin serving as the amorphous resin will be described.

Examples of monomers used for the polyester resin include di-, tri-, or higher carboxylic acids and di-, tri-, or higher hydric alcohols described in "Polymer data handbook: basic volume" (edited by The Society of Polymer Science, Japan; BAIFUKAN CO., LTD). Specific examples of these monomer components include the following compounds.

Dicarboxylic acids include dibasic acids that are succinic acid, adipic acid, sebacic acid, phthalic acid, isophthalic acid, terephthalic acid, malonic acid, and dodecenylsuccinic acid; anhydrides of the foregoing and lower alkyl esters of the foregoing; and aliphatic unsaturated dicarboxylic acids that are maleic acid, fumaric acid, itaconic acid, and citraconic acid. Tri- or higher carboxylic acids include 1,2,4-benzenetricarboxylic acid; and anhydrides of the foregoing and lower alkyl esters of the foregoing. These may be used alone or in combination of two or more thereof.

Examples of the dihydric alcohols include the following compounds:

bisphenol A, hydrogenated bisphenol A, ethylene oxide adducts of bisphenol A, propylene oxide adducts of bisphenol A, 1,4-cyclohexanediol, 1,4-cyclohexanedimethanol, ethylene glycol, and propylene glycol. Examples of the tri- or higher hydric alcohols include the following compounds: glycerin, trimethylolethane, trimethylolpropane, and pentaerythritol. These may be used alone or in combination of two or more thereof. If necessary, in order to adjust the acid value or the hydroxyl value, a monovalent acid such as acetic acid or benzoic acid or a monohydric alcohol such as cyclohexanol or benzyl alcohol may also be used.

The polyester resins can be synthesized from the above-described monomer components by publicly known methods.

Hereinafter, a polyurethane resin serving as the amorphous resin will be described.

A polyurethane resin is a reaction product of a diol and a diisocyanate. By changing the aliphatic diol and the diisocyanate, the function of the resultant resin can be changed.

Examples of the diisocyanate will be described below. Examples of the diisocyanate include aliphatic diisocyanates, alicyclic diisocyanates, aromatic diisocyanates, and modified products of these diisocyanates (modified products containing a urethane group, a carbodiimide group, an allophanate group, a urea group, a biuret group, a uretdione group, a uretonimine group, an isocyanurate group, and an oxazolidone group. Hereafter, modified products of diisocyanates may be referred to as modified diisocyanates.).

The aliphatic diisocyanates are preferably aliphatic diisocyanates having 4 or more and 12 or less carbons (excluding carbons in the isocyanate groups. Hereafter, same definition.) . Examples thereof are as follows:

ethylene diisocyanate, tetramethylene diisocyanate, hexamethylene diisocyanate (HDI), and dodecamethylene diisocyanate.

The alicyclic diisocyanates are preferably alicyclic diisocyanates having 4 or more and 15 or less carbons. Examples thereof are as follows:

isophorone diisocyanate (IPDI), dicyclohexylmethane-4, 4'-diisocyanate, cyclohexylene diisocyanate, and methylcyclohexylene diisocyanate.

The aromatic diisocyanates are preferably aromatic diisocyanates having 6 or more and 15 or less carbons. Examples thereof are as follows:

m- and/or p-xylylene diisocyanate (XDI) and $\alpha,\alpha,\alpha',\alpha'$-tetramethylxylylene diisocyanate.

Of these, preferred are aromatic diisocyanates having 6 or more and 15 or less carbons, aliphatic diisocyanates having 4 or more and 12 or less carbons, alicyclic diisocyanates having 4 or more and 15 or less carbons, and aromatic hydrocarbon diisocyanates having 8 or more and 15 or less carbons. In particular, preferred are hexamethylene diisocyanate (HDI), isophorone diisocyanate (IPDI), and xylylene diisocyanate (XDI).

In addition to the above-described diisocyanates, isocyanate compounds having a functionality of 3 or more may be used.

Examples of the diol are as follows:

alkylene glycols (ethylene glycol, 1,2-propylene glycol, and 1,3-propylene glycol); alkylene ether glycols (polyethylene glycol and polypropylene glycol); alicyclic diols (1,4-cyclohexanedimethanol); bisphenols (bisphenol A); and alkylene oxide (ethylene oxide or propylene oxide) adducts of the alicyclic diols. The alkyl moieties of the alkylene ether glycols may be linear or branched. In the present invention, alkylene glycols having a branched structure can be preferably used.

The glass transition temperature (Tg) of the amorphous resin contained in the binder resin A is preferably 50° C. or more and 130° C. or less, more preferably 70° C. or more and 130° C. or less. When Tg satisfies such a range, the toner even being melted tends to have elasticity.

In a toner according to the present invention, the binder resin A may be a block polymer in which a segment capable of forming a crystalline structure is chemically bonded to a segment not forming a crystalline structure.

This block polymer is a polymer in which polymers are bonded together through covalent bonds in a single molecule. Here, the segment capable of forming a crystalline structure is preferably a crystalline polyester and the segment not forming a crystalline structure is preferably a polyester or a polyurethane that are amorphous resins.

The block polymer may be an AB type diblock polymer including a segment (A) capable of forming a crystalline structure and a segment (B) not forming a crystalline structure; an ABA type triblock polymer; a BAB type triblock polymer; or an ABAB . . . type multiblock polymer. In the present invention, any of these configurations may be used.

In the block polymer, a bonding configuration in which a segment capable of forming a crystalline structure is bonded to a segment not forming a crystalline structure through a covalent bond is, for example, an ester bond, a urea bond, or a urethane bond. In particular, a block polymer in which bonding is achieved through urethane bonds is preferred. In the case of a block polymer in which bonding is achieved through urethane bonds, the toner even being melted tends to have elasticity.

The block polymer can be prepared by a method (two step method) in which a component forming a segment capable of forming a crystalline structure and a component forming a segment not forming a crystalline structure are separately prepared and these segments are bonded together. Alternatively, another method (one step method) may be used in which the starting material of a component forming a segment capable of forming a crystalline structure and the starting material of a component forming a segment not forming a crystalline structure are charged together and the polymer is prepared in a single step.

A block polymer according to the present invention can be synthesized by a method selected from various methods in consideration of the reactivity of end functional groups.

In the case of a block polymer in which a segment capable of forming a crystalline structure and a segment not forming a crystalline structure are both polyester resins, the block polymer can be prepared by separately preparing the components and then bonding the components together with a bonding agent. In particular, when one of the polyesters has a high acid value and the other polyester has a high hydroxyl value, the polyesters are heated under a reduced pressure without use of a bonding agent so that the condensation reaction can proceed. At this time, the reaction temperature is preferably about 200° C.

Note that when a bonding agent is used, examples of the bonding agent are as follows:

polycarboxylic acids, polyhydric alcohols, polyisocyanates, polyfunctional epoxy, and polyacid anhydrides.

Synthesis can be achieved with such a bonding agent through a dehydration reaction or an addition reaction.

In the case of a block polymer in which a segment capable of forming a crystalline structure is a crystalline polyester and a segment not forming a crystalline structure is a polyurethane, the polymer can be prepared by separately preparing the segments and then causing a urethane reaction between the alcohol end of the crystalline polyester and the isocyanate end of the polyurethane. Alternatively, synthesis can be achieved by mixing a crystalline polyester having an alcohol end with a diol and a diisocyanate that constitute a polyurethane, and heating the mixture. In this case, in the initial reaction stage in which the concentrations of the diol and the diisocyanate are high, the diol and the diisocyanate selectively react to form a polyurethane; after the molecular weight of the polyurethane increases to a certain degree, urethane formation occurs between the isocyanate end of the polyurethane and the alcohol end of the crystalline polyester.

The block polymer preferably has a number-average molecular weight (Mn) of 3,000 or more and 40,000 or less, more preferably 7,000 or more and 25,000 or less. The block polymer preferably has a weight-average molecular weight (Mw) of 10,000 or more and 60,000 or less, more preferably 20,000 or more and 50,000 or less. When such a range is satisfied, a high thermal storability can be maintained and, in addition, the toner can have a sharp melting characteristic.

Resin B

Hereinafter, the resin B will be described.

In a toner according to the present invention, the resin B preferably contains a resin having a polyester segment capable of forming a crystalline structure.

Examples of methods for introducing a crystalline polyester component serving as a segment capable of forming a crystalline structure into a resin are as follows:

(A) a method in which a vinyl-based monomer b1 including in the molecular structure a polyester segment capable of forming a crystalline structure and another vinyl-based monomer b2 (that is, a vinyl-based monomer not including in the molecular structure a polyester segment capable of forming a crystalline structure) are copolymerized; and (B) a method in which a vinyl-based monomer b1' serving as a precursor for introducing a polyester segment capable of forming a crystalline structure and another vinyl-based monomer b2 are copolymerized, and the reaction of the polyester segment capable of forming a crystalline structure is then caused.

Of these methods, the method (A) is preferred in view of the ease of introduction of the polyester segment. Hereinafter, the vinyl-based monomers b1, b1', and b2 will be described.

Vinyl-Based Monomer B1

The segment capable of forming a crystalline structure contained in the vinyl-based monomer b1 is preferably a crystalline polyester obtained by the reaction between an aliphatic diol having 4 or more and 20 or less carbons and a polycarboxylic acid.

In addition, the aliphatic diol is preferably a linear aliphatic diol that tends to provide a high crystallinity.

The aliphatic diol and the aliphatic polycarboxylic acid may be the same as those used for the binder resin A.

Examples of the method for producing the vinyl-based monomer b1 are as follows:

(1) a method in which an esterification reaction is caused between a vinyl-based monomer having a hydroxyl group or a vinyl-based monomer having a carboxyl group and the crystalline polyester component to produce a vinyl-based monomer including the crystalline polyester component in the molecular structure;

(2) a method in which a urethane reaction is caused between a vinyl-based monomer having an isocyanate group and the crystalline polyester component to produce a vinyl-based monomer including the crystalline polyester component in the molecular structure; and (3) a method in which urethane reactions are caused between a vinyl-based monomer having a hydroxyl group and a diisocyanate serving as a bonding agent and between the crystalline polyester component and the diisocyanate to produce a vinyl-based monomer including the crystalline polyester component in the molecular structure.

Of these methods, the methods (2) and (3) are particularly preferred in view of reactivity with the crystalline polyester component.

Here, when the introduction of a crystalline polyester component is performed by the esterification reaction with a carboxyl group or by the urethane reaction with an isocyanate group, the crystalline polyester component preferably has an alcohol end. Accordingly, in the crystalline polyester component, the molar ratio of diol to dicarboxylic acid (diol/dicarboxylic acid) is preferably 1.02 or more and 1.20 or less. On the other hand, when the introduction of a crystalline polyester component is performed by the esterification reaction with a hydroxyl group, the crystalline polyester component preferably has an acid end and the molar ratio of diol to dicarboxylic acid is preferably the inverse of the above-described ratio.

Examples of the vinyl-based monomer having a hydroxyl group are as follows:

hydroxystyrene, N-methylolacrylamide, N-methylolmethacrylamide, hydroxyethyl acrylate, hydroxyethyl methacrylate, hydroxypropyl acrylate, hydroxypropyl methacrylate, polyethylene glycol acrylate, polyethylene glycol monomethacrylate, allyl alcohol, methallyl alcohol, crotyl alcohol, isocrotyl alcohol, 1-butene-3-ol, 2-butene-1-ol, 2-butene-1,4-diol, propargyl alcohol, 2-hydroxyethyl propenyl ether, and sucrose allyl ether. Of these, particularly preferred is hydroxyethyl methacrylate.

Preferred examples of the vinyl-based monomer having a carboxyl group include unsaturated monocarboxylic acids and unsaturated dicarboxylic acids having 30 or less carbons, and anhydrides of the foregoing. Specific examples are as follows:

acrylic acid, methacrylic acid, maleic acid, fumaric acid, crotonic acid, itaconic acid, citraconic acid, isaconic acid, cinnamic acid, and anhydrides of the foregoing. Of these, particularly preferred are acrylic acid, methacrylic acid, maleic acid, and fumaric acid.

Examples of the vinyl-based monomer having an isocyanate group are as follows:

2-isocyanatoethyl acrylate, 2-isocyanatoethyl methacrylate, methacrylic acid 2-(0-[1'-methylpropylideneamino]carboxyamino)ethyl, 2-[(3,5-dimethylpyrazolyl)carbonylamino]ethyl methacrylate, and m-isopropenyl-α,α-dimethylbenzyl isocyanate.

Of these, particularly preferred are 2-isocyanatoethyl acrylate and 2-isocyanatoethyl methacrylate.

In a measurement of the crystalline polyester component of the vinyl-based monomer b1 with a differential scanning calorimeter (DSC), the peak temperature of a maximum endothermic peak is preferably 55.0° C. or more and 80.0° C. or less.

The tetrahydrofuran- (THF-) soluble matter of the crystalline polyester component contained in the molecular structure of the vinyl-based monomer b1, measured by gel permeation chromatography (GPC) preferably has a number-average molecular weight (Mn) of 1,000 or more and 20,000 or less, more preferably 2,000 or more and 15,000 or less; and a weight-average molecular weight (Mw) of 2,000 or more and 40,000 or less, more preferably 3,000 or more and 20,000 or less. When such a range is satisfied, a high thermal storability can be maintained and, in addition, the toner can have a sharp melting characteristic.

The proportion of the vinyl-based monomer b1 with respect to the amounts of all the monomers used for the copolymerization of the resin B is preferably 20.0% by mass or more and 50.0% by mass or less. By introducing a crystalline segment into the shell material so as to satisfy the range, the toner can have both a sharp melting characteristic and stress resistance.

When the proportion of the vinyl-based monomer b1 is 20.0% by mass or more, the low-temperature fixability is further enhanced. When the proportion of the vinyl-based monomer b1 is 50.0% by mass or less, the chargeability is enhanced and the stress resistance becomes high.

Vinyl-Based Monomer B1'

The vinyl-based monomer b1' is a monomer that serves as a precursor for introducing the crystalline polyester component and may be the vinyl-based monomer having a hydroxyl group, the vinyl-based monomer having a carboxyl group, or the vinyl-based monomer having an isocyanate group. The crystalline polyester component can be introduced by an esterification reaction or urethane reaction between such a group and the alcohol end or acid end of a crystalline polyester.

Vinyl-Based Monomer B2

Examples of the vinyl-based monomer b2 not including in the molecular structure a polyester segment capable of forming a crystalline structure include the following monomers:

aliphatic vinyl hydrocarbons: alkenes (ethylene, propylene, butene, isobutylene, pentene, heptene, diisobutylene, octene, dodecene, octadecene, and other α-olefins); and alkadienes (butadiene, isoprene, 1,4-pentadiene, 1,6-hexadiene, and 1,7-octadiene), alicyclic vinyl hydrocarbons: mono- or di-cycloalkenes and alkadienes (cyclohexene, cyclopentadiene, vinylcyclohexene, and ethylidenebicycloheptene); and terpenes (pinene, limonene, and indene), aromatic vinyl hydrocarbons: styrenes and hydrocarbyl (alkyl, cycloalkyl, aralkyl, and/or alkenyl) substituted styrenes (α-methylstyrene, vinyltoluene, 2,4-dimethylstyrene, ethylstyrene, isopropylstyrene, butylstyrene, phenylstyrene, cyclohexylstyrene, benzylstyrene, crotylstyrene, divinylbenzene, divinyltoluene, divinylxylene, and trivinylbenzene); and vinylnaphthalene, the above-described vinyl-based monomers having a carboxyl group and/or a carboxylate group: unsaturated monocarboxylic acids and unsaturated dicarboxylic acids having 3 or more and 30 or less carbons, and anhydrides of the foregoing (vinyl-based monomers having a carboxyl group that are maleic acid, maleic anhydride, fumaric acid, crotonic acid, itaconic acid, citraconic acid and cinnamic acid), vinyl esters: vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxy acetate, vinyl benzoate, ethyl α-ethoxy acrylate, alkyl acrylates and alkyl methacrylates having a (linear or branched) alkyl group having 1 or more and 30 or less carbons (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, stearyl acrylate, and behenyl acrylate, vinyl-based monomers having a polyalkylene glycol chain (polyethylene glycol (molecular weight: 300) monoacrylate, polyethylene glycol (molecular weight: 300) monomethacrylate, polypropylene glycol (molecular weight: 500) monoacrylate, polypropylene glycol (molecular weight: 500) monomethacrylate, methyl alcohol ethylene oxide (ethylene oxide will be abbreviated as EO hereafter) 10 mol adduct acrylate, methyl alcohol ethylene oxide (ethylene oxide will be abbreviated as EO hereafter) 10 mol adduct methacrylate, lauryl alcohol EO 30 mol adduct acrylate, and lauryl alcohol EO 30 mol adduct methacrylate, polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate.

Other than the above-described monomers, the vinyl-based monomer b2 may be a vinyl-based monomer having an organic polysiloxane structure (vinyl-based monomer y).

Organic polysiloxane is a material having a low interfacial tension. By using the vinyl-based monomer having an organic polysiloxane structure as a material of the resin B, a toner in which contamination of members due to fusion bonding of the toner is more effectively suppressed can be provided.

Use of the vinyl monomer having an organic polysiloxane structure is suitable in view of use of the resin as a material of a dispersing agent in the production of toner particles described below in which carbon dioxide in a high pressure state is used as a dispersion medium.

Here, the organic polysiloxane structure is a structure having a repeating unit of Si—O bond in which two monovalent organic groups are bonded to each Si atom.

Examples of the organic groups include alkyl groups, cycloalkyl groups, aryl groups, and aralkyl groups. These organic groups may have substituents. The organic groups may be the same or different. Among the organic groups, alkyl groups and aryl groups are preferred because advantages of organic polysiloxane described below tend to be exhibited. More preferred are alkyl groups having 1 or more and 3 or less carbons and particularly preferred are methyl groups.

A preferred example of the vinyl-based monomer having an organic polysiloxane structure is provided as the following chemical formula (1).

[Chem. 1]

Chemical formula (1)

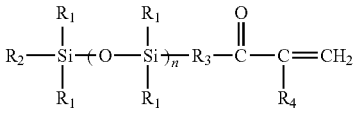

Here, $R_1$ and $R_2$ each preferably independently represent an alkyl group that may optionally have a substituent or an aryl group that may optionally have a substituent. Of these, more preferred is an alkyl group having 1 or more and 3 or less carbons and particularly preferred is a methyl group. $R_3$ preferably represents an alkylene group and preferably has 1 or more and 10 or less carbons. $R_4$ preferably represents a hydrogen atom or a methyl group. n represents the degree of polymerization and is preferably an integer of 2 or more and 100 or less, more preferably 2 or more and 15 or less.

The proportion of the vinyl-based monomer having an organic polysiloxane structure with respect to the amounts of all the monomers used for the copolymerization of the resin B is preferably 5.0% by mass or more and 20.0% by mass or less. When the vinyl-based monomer having an organic polysiloxane structure satisfies this range, the stress resistance and fixability are enhanced.

The segment having an organic polysiloxane structure may be introduced by a reaction between organic polysiloxane in which one end is modified with a carbinol group, a carboxyl group, or an epoxy group, and a group that can react with such a group and has been introduced into the resin B in advance.

A method for preparing the vinyl-based monomer having an organic polysiloxane structure is not particularly limited. For example, the vinyl-based monomer can be prepared by subjecting one end of organic polysiloxane to carbinol modification and then causing a dehydrochlorination reaction between the organic polysiloxane and acrylic acid chloride or methacrylic acid chloride.

In a toner according to the present invention, the vinyl-based monomer b2 preferably contains a vinyl-based monomer (vinyl-based monomer x) having, as a homopolymer, a glass transition temperature of 105° C. or more.

Examples of the vinyl-based monomer having, as a homopolymer, a glass transition temperature (Tg (° C.)) of 105° C. or more (hereafter, also referred to as a high-Tg vinyl-based monomer) are as follows:

dimethylacrylamide (Tg=114° C.), acrylamide (Tg=191° C.), monomethylacrylamide (Tg=171° C.), tert-butyl methacrylate (Tg=107° C.), vinylbenzoic acid (Tg=177° C.), 2-methylstyrene (Tg=127° C.), acrylic acid (Tg=111° C.), methacrylic acid (Tg=170° C.), methyl methacrylate (Tg=107° C.), and 4-hydroxystyrene (Tg=156° C.)

Of these, methacrylic acid (Tg=170° C.), methyl methacrylate (Tg=107° C.), and acrylic acid (Tg=111° C.) are particularly preferred.

Note that the values of glass transition temperatures Tg of the homopolymers are citations of medians of measurement results of homopolymers alone (numerical values described as medians of neat resins) from values in the polymer database (polyinfo) in National Institute for Materials Science (NIMS).

The proportion of the high-Tg vinyl-based monomer with respect to the amounts of all the monomers used for the copolymerization of the resin B is preferably 3.0% by mass or more and 15.0% by mass or less, more preferably 3.0% by mass or more and 10.0% by mass or less. When the high-Tg vinyl-based monomer satisfies such a range, the viscosity of the toner during fixing can be properly adjusted and stress resistance and low-temperature fixability can be both achieved.

In a toner according to the present invention, the resin B preferably has a number-average molecular weight (Mn) of 8,000 or more and 40,000 or less, more preferably 8,000 or more and 25,000 or less. The resin B preferably has a weight-average molecular weight (Mw) of 15,000 or more and 110,000 or less, more preferably 20,000 or more and 80,000 or less. When the values of Mn and Mw satisfy such ranges, low-temperature fixability and stress resistance tend to be both achieved.

A resin forming a shell phase in the present invention preferably does not dissolve in a dispersion medium so that the dispersibility of a material forming the core in the dispersion medium is maintained in the case of producing the toner particles by a method described below. In order to suppress dissolution of the resin forming a shell phase in the dispersion medium, a crosslinked structure may be introduced into the resin.

The proportion of the resin B in the resin forming a shell phase in the present invention is preferably 50.0% by mass or more. In particular, use of the resin B alone for the shell phase without other resins is preferred.

In a toner according to the present invention, in the toner particles, the content of the resin B with respect to 100 parts by mass of the core is preferably 3.0 parts by mass or more and 15.0 parts by mass or less. When the content of the resin B satisfies this range, the thickness of the shell phase is not excessively large and the surfaces of the toner particles are sufficiently covered. Thus, stress resistance and low-temperature fixability can be both achieved.

In a toner according to the present invention, TpA and TpB described above preferably satisfy the following formula (3).

$$-10.0 \leq (TpB - TpA) \leq 15.0 \quad (3)$$

More preferably, TpA and TpB satisfy the following formula (4).

$$-5.0 \leq (TpB - TpA) \leq 10.0 \quad (4)$$

When TpA and TpB satisfy the relationship of such a formula, stress resistance and low-temperature fixability can be both easily achieved.

Wax

Hereinafter, a wax will be described.

A toner according to the present invention contains a wax. The wax is not particularly limited and examples thereof are as follows:

aliphatic hydrocarbon-based waxes such as low-molecular-weight polyethylene, low-molecular-weight polypropylene, low-molecular-weight olefin copolymers, microcrystalline wax, paraffin wax, and Fischer-Tropsch wax; oxides of aliphatic hydrocarbon-based waxes such as polyethylene oxide wax; waxes mainly containing a fatty acid ester such as aliphatic hydrocarbon-based ester waxes; partially or wholly deoxidized fatty acid esters such as deoxidized carnauba wax; partially esterified products between a fatty acid and a polyhydric alcohol such as behenic acid monoglyceride; and methyl ester compounds having a hydroxyl group that are obtained by hydrogenating vegetable oils.

Of these, in view of ease of preparation of dispersion liquid in the case of using wax in the form of dispersion liquid, ease of entry into the produced toner, a property of seeping from the toner during fixing, and releasability, aliphatic hydrocarbon-based waxes and ester waxes are preferred. Of these, more preferred are ester waxes having a functionality of three or more, still more preferred are ester waxes having a functionality of four or more, and particularly preferred are ester waxes having a functionality of six or more.

Such an ester wax having a functionality of three or more is obtained by condensation between an acid having a functionality of three or more and a long-chain linear saturated alcohol, or by condensation between an alcohol having a functionality of three or more and a long-chain linear saturated fatty acid.

Examples of the alcohol having a functionality of three or more are as follows:

glycerin, trimethylolpropane, erythritol, pentaerythritol, sorbitol; and condensates of the foregoing: polyglycerins that are condensates of glycerin such as diglycerin, triglycerin, tetraglycerin, hexaglycerin, and decaglycerin; condensates of trimethylolpropane such as ditrimethylolpropane and tristrimethylolpropane; and condensates of pentaerythritol such as dipentaerythritol and trispentaerythritol.

Of these, preferred are structures having a branched moiety, more preferred are pentaerythritol and dipentaerythritol, and still more preferred is dipentaerythritol.

The long-chain linear saturated fatty acid is represented by a general formula $C_nH_{2n+1}COOH$ where n is preferably 5 or more and 28 or less.

Examples of the long-chain linear saturated fatty acid are as follows:

caproic acid, caprylic acid, octylic acid, nonylic acid, decanoic acid, dodecanoic acid, lauric acid, tridecanoic acid, myristic acid, palmitic acid, stearic acid, and behenic acid.

Of these, in view of the melting point of wax, myristic acid, palmitic acid, stearic acid, and behenic acid are preferred.

Examples of the acid having a functionality of three or more are as follows:

trimellitic acid and butanetetracarboxylic acid.

The long-chain linear saturated alcohol is represented by $C_nH_{2n+1}OH$ where n is preferably 5 or more and 28 or less.

Examples of the long-chain linear saturated alcohol are as follows:

capryl alcohol, lauryl alcohol, myristyl alcohol, palmityl alcohol, stearyl alcohol, and behenyl alcohol.

Of these, in view of the melting point of wax, myristyl alcohol, palmityl alcohol, stearyl alcohol, and behenyl alcohol are preferred.

A toner according to the present invention preferably has a wax content of 1.0% by mass or more and 20.0% by mass or less, more preferably 2.0% by mass or more and 15.0% by mass. When the wax content satisfies such a range, the releasability of the toner can be maintained and the thermal storability can be enhanced.

In a measurement of a wax according to the present invention with a differential scanning calorimeter (DSC), the peak temperature of a maximum endothermic peak is preferably 60° C. or more and 120° C. or less, more preferably 60° C. or more and 90° C. or less. When the peak temperature of a maximum endothermic peak of a wax satisfies such a range, exposure of the wax in the toner surfaces can be adjusted and thermal storability and low-temperature fixability can be both achieved.

Colorant

Hereinafter, a colorant will be described.

A toner according to the present invention contains a colorant for imparting a coloring power. Examples of a colorant preferably used in the present invention include organic pigments, organic dyes, and inorganic pigments below and colorants having been used for toners can be used. A colorant used in a toner according to the present invention is selected in view of hue angle, chroma, lightness, light resistance, OHP transparency, and dispersibility in the toner.

Examples of the colorant are as follows.

Examples of a yellow colorant include compounds represented by condensed azo compounds, isoindolinone compounds, anthraquinone compounds, azo metal complexes, methine compounds, and arylamide compounds. Specific examples are as follows:

C.I. Pigment Yellow 12, 13, 14, 15, 17, 62, 74, 83, 93, 94, 95, 97, 109, 110, 111, 120, 128, 129, 138, 147, 150, 151, 154, 155, 168, 180, 185, 213, and 214. These may be used alone or in combination of two or more thereof.

Examples of a magenta colorant include condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples are as follows:

C.I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, and 269, and C.I. Pigment Violet 19. These may be used alone or in combination of two or more thereof.

Examples of a cyan colorant include copper phthalocyanine compounds and derivatives thereof, anthraquinone compounds, and basic dye lake compounds.

Specific examples are as follows:

C.I. Pigment Blue 1, 7, 15, 15:1, 15:2, 15:3, 15:4, 60, 62, and 66. These may be used alone or in combination of two or more thereof.

Examples of a black colorant are as follows:

carbon blacks such as furnace black, channel black, acetylene black, thermal black, and lamp black; and metal oxides such as magnetite and ferrite.

In the present invention, when a colorant is used for a standard color toner, the content of the colorant with respect to the toner is preferably 2.0% by mass or more and 15.0% by mass or less, more preferably 2.5% by mass or more and 12.0% by mass or less. When the content of the colorant satisfies such a range, a sufficient coloring power is maintained and a large color space can be achieved. In addition to a standard color toner, a light color toner having a lower concentration may be preferably used. In this case, the content of the colorant with respect to the toner is preferably 0.5% by mass or more and 5.0% by mass or less.

Charge Controlling Agent

Hereinafter, a charge controlling agent will be described.

In a toner according to the present invention, if necessary, a charge controlling agent may be mixed with toner particles. A charge controlling agent may be added in the production of toner particles. By adding a charge controlling agent, the charge property is stabilized and the triboelectrification amount can be controlled to be optimum in accordance with the development system.

Publicly known charge controlling agents may be used. In particular, preferred are charge controlling agents that have a high charging speed and can maintain a certain charging amount with stability.

Examples of a charge controlling agent that controls the toner to be negatively charged are as follows:

organic metal compounds and chelate compounds; for example, monoazo metal compounds, acetylacetone metal compounds, aromatic oxycarboxylic acid-based metal compounds, aromatic dicarboxylic acid-based metal compounds, oxycarboxylic acid-based metal compounds, and dicarboxylic acid-based metal compounds. These charge controlling agents may be used alone or in combination of two or more thereof.

The amount of such a charge controlling agent added with respect to 100 parts by mass of the binder resin is preferably 0.01 parts by mass or more and 20 parts by mass or less, more preferably 0.5 parts by mass or more and 10 parts by mass or less.

External Additive

Hereinafter, an external additive will be described.

To toner particles used in the present invention, an inorganic fine powder serving as a flow improver is preferably added. Examples of the inorganic fine powder include silica fine powder, titanium oxide fine powder, alumina fine powder, and fine powders of composite oxides of the foregoing. In these inorganic fine powders, preferred are silica fine powder and titanium oxide fine powder.

Examples of the silica fine powder include dry silica or fumed silica generated by vapor-phase oxidation of a silicon halide, and wet silica produced from water glass. Regarding the inorganic fine powder, preferred is dry silica in which the amount of silanol groups in the surface and inside of the silica fine powder is small and the amounts of $Na_2O$ and $SO_3^{2-}$ are small. The dry silica may be a composite fine powder of silica and another metal oxide produced by using a metal halide compound such as aluminum chloride or titanium chloride and a silicon halide compound in the production step.

When an inorganic fine powder added to a toner absorbs moisture, the charging amount of the toner decreases and development properties or transfer properties tend to be degraded. Accordingly, such an inorganic fine powder is preferably treated so as to be hydrophobic so that the charging amount of the toner is adjusted, the environmental stability is enhanced, and characteristics under a high humidity environment are enhanced.

Examples of an agent used for treating an inorganic fine powder so as to be hydrophobic include unmodified silicone varnishes, various modified silicone varnishes, unmodified silicone oils, various modified silicone oils, silane compounds, silane coupling agents, other organosilicon compounds and organotitanium compounds. These agents for the treatment may be used alone or in combination.

In particular, preferred is an inorganic fine powder having been treated with silicone oil. More preferred is a silicone-oil-treated hydrophobic inorganic fine powder obtained by treating an inorganic fine powder with a coupling agent so as to be hydrophobic and simultaneously or subsequently treating the inorganic fine powder with silicone oil, so that a high charging amount of toner particles is maintained even under a high humidity environment and the development selectivity is reduced.

The amount of such an inorganic fine powder added with respect to 100 parts by mass of toner particles is preferably 0.1 parts by mass or more and 4.0 parts by mass or less, more preferably 0.2 parts by mass or more and 3.5 parts by mass or less.

Method for Producing Toner According to the Present Invention

Hereinafter, a method for producing toner according to the present invention will be described. Note that a toner according to the present invention is not necessarily limited to the toner produced by the production method.

As described above, a toner according to the present invention is preferably a toner having a core-shell structure in which a shell phase containing the resin B is formed on the surface of a core containing the binder resin A. The shell phase may be formed after the core is formed. However, for simplicity, the formation of the core and the formation of the shell phase are preferably simultaneously performed.

A process for forming the shell phase is not limited at all. An example of a process in which the shell phase is formed after the core is formed is as follows: core particles and resin fine particles that are to serve as the shell phase are dispersed in a dispersion medium, and the resin fine particles are subsequently aggregated and adsorbed onto the surfaces of the core particles.

A preferred example of a process of simultaneously performing the formation of the core and the formation of the shell phase is what is called a "dissolution suspension process". The dissolution suspension process denotes a process in which a resin that forms the core is dissolved in an organic solvent to prepare a resin composition; the obtained resin composition is dispersed in a dispersion medium to form a dispersion of liquid particles of the resin composition; and the organic solvent is then removed from the dispersion of liquid particles to thereby provide resin particles. In this case, resin fine particles that are to form the shell phase are dispersed in the dispersion medium in advance, and the resin fine particles are made to adhere to the surfaces of the liquid particles to thereby form the shell phase.

In general, the dispersion medium is an aqueous medium. In the present invention, in particular, production in a nonaqueous medium is preferred. This is because production of toner particles in a nonaqueous medium allows tendency of arrangement of a hydrophobic material on the surfaces of the toner particles; as a result, the resin B containing an organic polysiloxane structure tends to form a shell phase having a low interfacial tension and adhesion of the toner to members can be suppressed.

In particular, in a method for producing toner particles according to the present invention, preferred is a dissolution suspension process employing carbon dioxide in a high pressure state as the dispersion medium.

Specifically, in the present invention, the toner particles are preferably formed by (I) a step of obtaining a resin composition in which a binder resin and a colorant are dissolved or dispersed in a medium containing an organic solvent, (II) a step of obtaining a dispersion by dispersing the resin composition in a dispersion medium containing resin fine particles containing the resin B and carbon dioxide that is in a high pressure state, and (III) a step of removing the organic solvent from the dispersion.

Here, the carbon dioxide in a high pressure state denotes carbon dioxide that is at a pressure of 1.0 MPa or more and 20.0 MPa or less. A dispersion medium containing carbon dioxide in a high pressure state alone may be used as the dispersion medium. The dispersion medium may contain an organic solvent as another component. In this case, the carbon dioxide in a high pressure state and the organic solvent preferably form a homogenous phase. The carbon dioxide preferably has a temperature of 10° C. or more and 40° C. or less. The resin composition may further contain a wax.

Hereinafter, an example of a method for producing toner particles in which a dispersion medium containing carbon dioxide in a high pressure state is used, the method being suitable for obtaining toner particles used in the present invention, will be described.

A binder resin, a colorant, a wax, and optionally another additive are added to an organic solvent that can dissolve the binder resin therein, and uniformly dissolved or dispersed with a dispersion apparatus such as a homogenizer, a ball mill, a colloid mill, or an ultrasonic dispersion apparatus. Subsequently, the thus-obtained dissolution liquid or dispersion liquid (hereafter, simply referred to as a binder-resin dissolution liquid) is dispersed in a dispersion medium containing carbon dioxide in a high pressure state to thereby form oil droplets.

At this time, a dispersing agent needs to be dispersed in the dispersion medium containing carbon dioxide in a high pressure state. The dispersing agent used is a resin-fine-particle dispersing agent containing the resin B for forming a shell phase. The dispersing agent adsorbed on the surfaces of the oil droplets remains there even after the formation of toner particles. Accordingly, toner particles in which surfaces are covered with the resin fine particles can be formed.

At this time, a dispersing agent needs to be dispersed in the dispersion medium containing carbon dioxide in a high pressure state. The dispersing agent used may be resin fine particles containing the resin B for forming a shell phase. Additional component may be mixed as a dispersing agent. An inorganic-fine-particle dispersing agent, an organic-fine-particle dispersing agent, or mixtures thereof may be used and two or more of the foregoing may be used in combination depending on the purpose.

Examples of the inorganic-fine-particle dispersing agent include inorganic particles of alumina, zinc oxide, titania, and calcium oxide.

In addition to the resin B, examples of the organic-fine-particle dispersing agent are as follows:

vinyl resins, urethane resins, epoxy resins, ester resins, polyamide, polyimide, silicone resins, fluorocarbon resins, phenol resins, melamine resins, benzoguanamine-based resins, urea resins, aniline resins, ionomer resins, polycarbonate, cellulose, and mixtures of the foregoing. These may have a crosslinked structure.

The content of the resin fine particles forming the shell phase with respect to the binder resin is preferably 3.0% by mass or more and 30.0% by mass or less. The resin constituting the resin fine particles contains 50% by mass or more of the resin B.

In the present invention, in view of the formation of a core-shell structure in toner particles, the fine particles containing the resin B preferably have a number-average particle size of 30 nm or more and 300 nm or less, more preferably 50 nm or more and 200 nm or less. When the fine particles containing the resin B has a particle size satisfying such a range, the shell phase can be properly formed.

In the present invention, a process of dispersing the dispersing agent in a dispersion medium containing carbon dioxide in a high pressure state may be any process. Specific examples include a process in which the dispersing agent and a dispersion medium containing carbon dioxide in a high pressure state are charged into a vessel and the dispersing agent is directly dispersed by stirring or ultrasonic radiation, or a process in which a dispersion liquid in which the dispersing agent is dispersed in an organic solvent is introduced with a high-pressure pump into a vessel containing a dispersion medium containing carbon dioxide in a high pressure state.

In the present invention, a process of dispersing the binder-resin dissolution liquid in a dispersion medium containing carbon dioxide in a high pressure state may be any process. Specific examples include a process in which the binder-resin dissolution liquid is introduced with a high-pressure pump into a vessel containing a dispersion medium containing carbon dioxide in a high pressure state in which the dispersing agent is dispersed. Alternatively, a dispersion medium containing carbon dioxide in a high pressure state in which the dispersing agent is dispersed may be introduced into a vessel containing the binder-resin dissolution liquid.

In the present invention, it is important that the dispersion medium containing carbon dioxide in a high pressure state is in a single phase. When particles are formed by dispersing the binder-resin dissolution liquid in a dispersion medium containing carbon dioxide in a high pressure state, a portion of the organic solvent in oil droplets enters the dispersion. At this time, when the phase of carbon dioxide and the phase of the organic solvent are present as separate phases, the stability of the oil droplets may be degraded, which is not preferred. Accordingly, the temperature or pressure of the dispersion medium and the amount of the binder-resin dissolution liquid with respect to the dispersion medium containing carbon dioxide in a high pressure state are preferably adjusted such that carbon dioxide and the organic solvent can form a homogenous phase.

In addition, the temperature and pressure of the dispersion medium need to be considered in terms of formability of particles (ease of formation of oil droplets) and solubility of constituent components of the binder-resin dissolution liquid in the dispersion medium. For example, a binder resin or a wax in the binder-resin dissolution liquid may dissolve in the dispersion medium depending on the temperature condition or the pressure condition. In general, the lower the temperature and the pressure, the lower the solubility of the components in the dispersion medium; however, the formed oil droplets tend to flocculate and coalesce and the formability of particles is degraded. On the other hand, the higher the temperature and the pressure, the better the formability of particles; however, the components tend to dissolve in the dispersion medium. Accordingly, in the production of toner particles according to the present invention, the temperature of the dispersion medium is preferably 10° C. or more and 40° C. or less.

The internal pressure of a vessel in which the dispersion medium is formed is preferably 1.0 MPa or more and 20.0 MPa or less, more preferably 2.0 MPa or more and 15.0 MPa or less. Note that, in the present invention, when the dispersion medium contains a component in addition to carbon dioxide, the pressure denotes the total pressure.

After formation of particles is thus completed, the organic solvent remaining in the oil droplets can be removed with carbon dioxide in a high pressure state. Specifically, the dispersion medium in which the oil droplets are dispersed is further mixed with carbon dioxide in a high pressure state; the remaining organic solvent is extracted to the phase of carbon dioxide; this carbon dioxide containing the organic solvent is replaced with the new carbon dioxide in a high pressure state.

In the mixing of the dispersion medium and the carbon dioxide in a high pressure state, carbon dioxide having a higher pressure than the dispersion medium may be added to the dispersion medium, or the dispersion medium may be added to carbon dioxide having a lower pressure than the dispersion medium.

A process of replacing carbon dioxide containing an organic solvent with another dispersion medium containing carbon dioxide in a high pressure state may be a process in which, while the internal pressure of the vessel is maintained constant, the dispersion medium containing carbon dioxide in a high pressure state is passed. This process is performed while toner particles formed are captured with a filter.

When the replacement with carbon dioxide in a high pressure state is not sufficiently performed and the organic solvent remains in the dispersion medium, the following disadvantages may be caused: when the pressure of the vessel is reduced for collecting the obtained toner particles, the organic solvent dissolved in the dispersion medium is condensed and the toner particles dissolve again or the toner particles coalesce together. Accordingly, the replacement with carbon dioxide in a high pressure state needs to be performed until the organic solvent is completely removed. The flow amount of carbon dioxide in a high pressure state is preferably 1 or more and 100 or less times the mass of the dispersion medium, more preferably 1 or more and 50 or less times, still more preferably 1 or more and 30 or less times.

When the pressure of the vessel is reduced to take toner particles out of a dispersion containing a dispersion medium containing carbon dioxide in a high pressure state in which the toner particles are dispersed, pressure reduction to normal pressure at normal temperature may be performed in a single step; alternatively, the pressure reduction may be performed in a stepwise manner with multiple vessels whose pressures are independently controlled. The speed of pressure reduction is preferably set such that carbon dioxide remaining in the toner particles does not bubble. Note that the organic solvent and the dispersion medium containing carbon dioxide in a high pressure state that are used in the present invention can be recycled.

Hereinafter, a toner according to the present invention and methods for measuring various properties of the toner material will be described.

<Method for Measuring T(5), t(1), and t(5) with Constant Load Extrusion-Type Capillary Rheometer>

The melting rate of a toner is measured with a constant load extrusion-type capillary rheometer "rheological property evaluation instrument Flowtester CFT-500D" (manufactured by SHIMADZU CORPORATION) in accordance with a manual supplied with the instrument. In this instrument, while a constant pressure is applied with a piston onto a measurement sample charged into a cylinder, the measurement sample within the cylinder is heated to melt and the melted measurement sample is extruded through a die in a bottom portion of the cylinder; at this time, a flow curve representing the relationship between time and downward displacement of piston (displacement) can be obtained.

The measurement sample is prepared by press-molding a toner ($0.20\times\rho g$; ($\rho$(g/cm$^3$) is the true density of the toner) in an environment at 25° C. with a tablet press (for example, NT-100H manufactured by NPa SYSTEM CO., LTD.) at 12 MPa for 60 seconds so as to have a cylindrical form having a base area of 1.0 cm$^2$ (diameter: 11.3 mm) and a thickness of 2.2 mm.

The measurement conditions are as follows.

Test mode: constant temperature method

Measurement temperature: 50° C. to 120° C. (measured in 5° C. increments)

Base area of piston (area of measurement pressure-application surface): 1.0 cm$^2$ Test load (piston load): 1.0 MPa or 5.0 MPa Preheating time: 0 seconds Diameter of die orifice: 1.0 mm Length of die: 1.0 mm Initiation of measurement: The measurement (application of pressure) is initiated after 15 seconds have elapsed from charging of the measurement sample into a cylinder and setting of the piston.

The value of T(5) is determined in the following manner. The test load (pressure) is set at 5.0 MPa and, at a temperature of 50° C., the time over which the displacement reaches 2.0 mm from the initiation of the pressure application is measured. This process is similarly performed for new measurement samples except that the temperature is changed to temperatures from 50° C. to 120° C. in 5° C. increments. Thus, at each temperature, the time over which the displacement reaches 2.0 mm from the initiation of the pressure application is measured. From the obtained measurement results, the temperature is plotted along the abscissa axis and the time over which the displacement reaches 2.0 mm is plotted along the ordinate axis to generate a temperature-time curve. In the obtained temperature-time curve, the temperature at which the displacement reaches 2.0 mm after 10 seconds from the initiation of the pressure application is read and this temperature is defined as T(5) [° C.].

In addition, a measurement is performed at a measurement temperature of 70° C. and a test load (pressure) of 1.0 MPa. In the resultant flow curve, the time over which the displacement reaches 2.0 mm from the initiation of the pressure application is read and this time is defined as t(1) [s].

Similarly, a measurement is performed at a measurement temperature of 70° C. and a test load (pressure) of 5.0 MPa. In the resultant flow curve, the time over which the displacement reaches 2.0 mm from the initiation of the pressure application is read and this time is defined as t(5) [s].

<Method for Measuring Peak Temperature of Maximum Endothermic Peak>

In the present invention, the peak temperature of a maximum endothermic peak is measured with a DSC Q1000 (manufactured by TA Instruments) under the following conditions.

Temperature rising rate: 10° C./min

Measurement start temperature: 20° C.

Measurement end temperature: 180° C.

In the detection unit of the instrument, temperature correction is performed on the basis of the melting points of indium and zinc and calorimetric correction is performed on the basis of the heat of fusion of indium.

Specifically, 5 mg of a sample (toner or resin) is accurately weighed into a silver pan and subjected to a measurement. From an endothermic curve obtained in this measurement, the peak temperature of a maximum endothermic peak is determined. For reference, an empty silver pan is used. Note that, in the present invention, the peak temperature of a maximum endothermic peak during the first temperature rise of the toner is defined as Tp (° C.).

Note that, in the present invention, the "melting point" of a crystalline substance (for example, crystalline polyester)

denotes the peak temperature of a maximum endothermic peak measured by the above-described method during the first temperature rise of the crystalline substance.

<Measurement of Glass Transition Temperature>

The glass transition temperature of an amorphous resin is determined in the following manner. In a reversing heat flow curve during temperature rise obtained in the DSC measurement, tangents of a curve representing endothermic change that are pre-change and post-change base lines are drawn and the midpoint of a line extending between points of intersection on the tangents is determined. The temperature at the midpoint is defined as the glass transition temperature.

<Method for Measuring Weight-Average Particle Size (D4) and Number-Average Particle Size (D1)>

The weight-average particle size (D4) and number-average particle size (D1) of a toner are calculated in the following manner. The measurement instrument is an accurate particle size distribution measurement instrument "COULTER COUNTER Multisizer 3" (registered trademark, manufactured by Beckman Coulter, Inc.) having a 100 μm aperture tube and employing a small aperture electric resistance method. The setting of measurement conditions and analysis of measurement data are performed with a bundled special software "Beckman Coulter Multisizer 3 Version 3.51" (manufactured by Beckman Coulter, Inc.). Note that the measurement is performed with 25,000 effective measurement channels.

An electrolytic aqueous solution used in the measurement is a solution prepared by dissolving guaranteed sodium chloride in ion-exchanged water so as to have a concentration of about 1% by mass. For example, "ISOTON II" (manufactured by Beckman Coulter, Inc.) can be used.

Note that, prior to the measurement and analysis, the above-described special software is set in the following manner.

In the "Edit the Standard Operating Method (SOM)" window in the special software, the Total count in the Control Mode is set to 50000 particles; the Number of Runs is set to 1; the Kd is set to a value determined with "particle standard 10.0 μm" (manufactured by Beckman Coulter, Inc.). By pressing "Measure threshold/noise level button", the threshold and the noise level are automatically set. In addition, the Current is set to 1600 pA; the Gain is set to 2; the Electrolyte is set to ISOTON II; and "Flush Aperture Tube after each run" is checked.

In the "Convert Pulses to Size settings" window in the special software, the Bin Spacing is set to Log Diameter; the Size Bins is set to 256; and the range of particle size is set to from 2 μm to 60 μm.

Specifically, the measurement method will be described below.

(1) The above-described electrolytic aqueous solution (about 200 ml) is charged into a 250 ml round bottom glass beaker dedicated to Multisizer 3. This beaker is set in the sample stand and stirring with a stirrer rod is performed in the counterclockwise direction at 24 revolutions per second. By using the "Flush Aperture" function in the special software, contamination and air bubbles within the aperture tube are removed.

(2) The above-described electrolytic aqueous solution (about 30 ml) is charged into a 100 ml flat bottom glass beaker. To this beaker, about 0.3 ml of a diluted solution is added as a dispersing agent, the solution being prepared by diluting "Contaminon N" (10 mass % aqueous solution of neutral detergent (pH 7) for cleaning precision measurement instruments, composed of a nonionic surfactant, an anionic surfactant, and an organic builder; manufactured by Wako Pure Chemical Industries, Ltd.) with ion-exchanged water such that the resultant mass is substantially tripled.

(3) An "Ultrasonic Dispersion System Tetora 150" (manufactured by Nikkaki-Bios Co., Ltd.) is prepared: the ultrasonic dispersion system contains two radiators having a radiation frequency of 50 kHz, a phase difference of 180° from each other, and an electric output of 120 W. About 3.3 L of ion-exchanged water is charged into the water tank of the ultrasonic dispersion system. About 2 mL of Contaminon N is added to the water tank.

(4) The beaker in (2) is set into a beaker holding hole of the ultrasonic dispersion system and the ultrasonic dispersion system is operated. The height level of the beaker is adjusted such that the resonance of the liquid surface of the electrolytic aqueous solution in the beaker is maximized.

(5) While the electrolytic aqueous solution in the beaker in (4) is subjected to ultrasonic radiation, about 10 mg of a toner is added in small portions to the electrolytic aqueous solution and dispersed. Furthermore, the ultrasonic dispersion treatment is continuously performed for 60 seconds. Note that, during the ultrasonic dispersion, the liquid temperature of the water tank is properly adjusted so as to be 10° C. or more and 40° C. or less.

(6) To the round bottom beaker placed in the sample stand in (1), the electrolytic aqueous solution in which the toner is dispersed in (5) is dropped with a pipette and adjustment is performed such that the measurement concentration becomes about 5%. The measurement is then performed until the number of measured particles reaches 50000.

(7) The measurement data is analyzed with the special software bundled with the instrument to calculate the weight-average particle size (D4) and number-average particle size (D1). Note that, in the special software, in the case of setting to Graph/Volume %, "Mean Diameter" in the "Analysis/Volume Statistic (Arithmetic Mean)" window represents the weight-average particle size (D4); and, in the special software, in the case of setting to Graph/Number %, "Mean Diameter" in the "Analysis/Number Statistic (Arithmetic Mean)" window represents the number-average particle size (D1).

<Method for Measuring Number-Average Molecular Weight Mn and weight-average molecular weight Mw>

The number-average molecular weight Mn and the weight-average molecular weight Mw of a resin according to gel permeation chromatography (GPC) are obtained by measuring the tetrahydrofuran- (THF-) soluble matter of the resin by GPC employing THF as the solvent. The measurement conditions are as Follows.

(1) Preparation of measurement sample

A toner (sample) and THF are mixed together so as to achieve a concentration of 5 mg/mL, left at room temperature for 6 hours, then sufficiently shaken such that THF and the sample are fully mixed until the coalescent matter of the sample is no longer present, and further left at rest at room temperature for 3 hours. At this time, the time from the initiation of mixing of the sample and THF to the end of resting is adjusted to be 12 or more hours.

After that, the mixture is passed through a sample treatment filter (pore size: 0.5 μm, Maishori Disc H-25-2 [manufactured by Tosoh Corporation]) to provide a sample for GPC.

(2) Measurement of Sample

A column is stabilized in a heat chamber at 40° C. THF serving as a solvent is passed through the column at the temperature at a flow rate of 1 ml/min; and a THF sample solution (100 μl) of the resin adjusted to have a sample concentration of 5 mg/mL is injected and measured.

The molecular weight of the sample is determined from the molecular weight distribution of the sample by calculation based on the relationship of a logarithm-count calibration curve generated with several monodisperse polystyrene standard samples.

The polystyrene standard samples used for generating the calibration curve are samples manufactured by Pressure Chemical Co. and Tosoh Corporation and having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. In addition, a detector that is an RI (refractive index) detector is used.

In order to achieve proper measurements for the molecular-weight range of $1\times10^3$ to $2\times10^6$, the column is a combination of a plurality of commercially available polystyrene gel columns as described below. In the present invention, measurement conditions of GPC are as follows.

[GPC Measurement Conditions]

Instrument: LC-GPC 150C (manufactured by Waters Corporation)

Column: series of seven columns that are KF 801, 802, 803, 804, 805, 806, and 807 (manufactured by Shodex)

Column temperature: 40° C.

Mobile phase: THF (tetrahydrofuran)

<Method for Measuring Particle Sizes of Colorant Particles, Wax Particles, and Resin Fine Particles for Shell>

The particle sizes of the above-described fine particles are measured with a Microtrac particle size distribution measurement instrument HRA (X-100) (manufactured by NIKKISO CO., LTD.) with range setting of 0.001 μm to 10 μm. Each particle size is measured as a volume-average particle size (in μm or nm). Note that water is selected as a dilution solvent.

<Method for Calculating Proportion (Mass %) of Segment Capable of Forming Crystalline Structure>

The proportion (mass %) of a segment capable of forming a crystalline structure in a binder resin is measured by $^1$H-NMR under the following conditions.

Measurement instrument: FT NMR instrument JNM-EX400 (manufactured by JEOL Ltd.)

Measurement frequency: 400 MHz

Pulse condition: 5.0 μs

Frequency range: 10500 Hz

Number of integration: 64

Measurement temperature: 30° C.

Sample: sample prepared by placing 50 mg of a resin in a sample tube having an inner diameter of 5 mm, adding deuterochloroform ($CDCl_3$) as a solvent, and dissolving the resin in a constant temperature bath at 40° C.

In a $^1$H-NMR chart obtained by a measurement under the above-described measurement conditions, from peaks that are attributable to a constituent component of a segment capable of forming a crystalline structure, peaks that are independent from peaks that are attributable to other constituent components are selected and the integral $S_1$ of the selected peaks is calculated. Similarly, from peaks that are attributable to a constituent component of an amorphous segment, peaks that are independent from peaks that are attributable to other constituent components are selected and the integral $S_2$ of the selected peaks is calculated. The proportion of the segment capable of forming a crystalline structure is determined from the integral $S_1$ and the integral $S_2$ in a manner described below. Note that $n_1$ and $n_2$ denote the number of hydrogens in the constituent components to which the selected peaks are attributed.

$$\text{Proportion(mol \%) of segment capable of forming crystalline structure}=\{(S_1/n_1)/((S_1/n_1)+(S_2/n_2))\}1\times100$$

The thus-obtained proportion (mol %) of a segment capable of forming a crystalline structure is converted in mass % with the molecular weights of the components.

<Measurement of True Density of Toner>

The true density of a toner is measured by charging 2.0 g of the toner into an SM cell (10 ml) and using a dry automatic density meter Autopycnometer (manufactured by Yuasa-Ionics Co., Ltd.).

This measurement instrument is used to measure the true density of solid or liquid on the basis of the gas phase displacement method. This method is based on the Archimedes' principle as with the liquid phase displacement method; but, gas (argon gas) is used as a displacement medium and hence high accuracy can be achieved.

EXAMPLES

Hereinafter, the present invention will be described further in detail with reference to Examples. However, the present invention is not limited to the Examples at all. Note that parts and % in Examples and Comparative examples are all based on mass unless otherwise specified.

<Synthesis Example of Crystalline Polyester 1>

| | |
|---|---|
| sebacic acid | 124.0 parts by mass |
| 1,6-hexanediol | 76.0 parts by mass |
| dibutyltin oxide | 0.1 parts by mass |

These were charged into a reaction vessel equipped with a stirrer and a thermometer under purging with nitrogen. In the system, purging with nitrogen was performed by a pressure reduction process and then stirring was performed at 250° C. for an hour. After the product became viscous, it was air-cooled to terminate the reaction. Thus, a crystalline polyester 1 was synthesized. The physical properties of the crystalline polyester 1 are described in Table 1.

<Synthesis Examples of Crystalline Polyesters 2 to 5>

Synthesis of crystalline polyesters 2 to 5 was performed as with the synthesis example of the crystalline polyester 1 except that the amounts of the acid component and the alcohol component charged were changed as described in Table 1. The physical properties of the crystalline polyesters 2 to 5 are described in Table 1.

<Synthesis Example of Crystalline Polyester 6>

| | |
|---|---|
| sebacic acid | 134.0 parts by mass |
| 1,4-butanediol | 66.0 parts by mass |
| dibutyltin oxide | 0.1 parts by mass |

These were charged into a reaction vessel equipped with a stirrer and a thermometer under purging with nitrogen. In the system, purging with nitrogen was performed by a pressure reduction process and then stirring was performed at 180° C. for 6 hours. After that, the temperature gradually rose to 230° C. under stirring and the reduced pressure, and this state was then maintained for 2 hours. After the product became viscous, it was air-cooled to terminate the reaction. Thus, a crystalline polyester 6 was synthesized. The physical properties of the crystalline polyester 6 are described in Table 1.

<Synthesis Examples of Crystalline Polyesters 7 and 8>

Synthesis of crystalline polyesters 7 and 8 was performed as with the synthesis example of the crystalline polyester 6 except that the amounts of the acid component and the alcohol component charged were changed as described in Table 1. The physical properties of the crystalline polyesters 7 are described in Table 1.

<Synthesis Example of Amorphous Polyurethane 1>

| | |
|---|---|
| xylylene diisocyanate (XDI) | 48.0 parts by mass |
| cyclohexanedimethanol (CHDM) | 27.0 parts by mass |
| tetrahydrofuran (THF) | 80.0 parts by mass |

These were charged into a reaction vessel equipped with a stirrer and a thermometer under purging with nitrogen. The solution was heated to 50° C. to cause a urethane reaction for 10 hours. After cooling, the solvent was evaporated with an evaporator to obtain an amorphous polyurethane 1. The amorphous polyurethane 1 had a number-average molecular weight Mn of 3,500, a weight-average molecular weight Mw of 6,500, a Mw/Mn of 1.9, and a glass transition temperature Tg of 140.0° C.

<Synthesis Example of Amorphous Polyester 1>

| | |
|---|---|
| 2 mol propylene oxide adduct of bisphenol A | 30.0 parts by mass |
| 2 mol ethylene oxide adduct of bisphenol A | 33.0 parts by mass |
| terephthalic acid | 21.0 parts by mass |
| trimellitic anhydride | 1.0 part by mass |
| fumaric acid | 3.0 parts by mass |
| dodecenylsuccinic acid | 12.0 parts by mass |
| dibutyltin oxide | 0.1 parts by mass |

These were charged into a reaction vessel equipped with a stirrer and a thermometer under purging with nitrogen. Stirring was performed at 215° C. for 5 hours. After that, the temperature gradually rose to 230° C. under stirring and a reduced pressure, and this state was then maintained for 2 hours. After the product became viscous, it was air-cooled to terminate the reaction. Thus, an amorphous polyester 1 was obtained. The amorphous polyester 1 had a number-average molecular weight Mn of 7,200, a weight-average molecular weight Mw of 43,000, a Mw/Mn of 6.0, and a glass transition temperature Tg of 63.0° C.

<Synthesis Example of Amorphous Polyester 2>

| | |
|---|---|
| terephthalic acid | 83.0 parts by mass |
| 2 mol ethylene oxide adduct of bisphenol A | 187.0 parts by mass |
| dibutyltin oxide | 0.1 parts by mass |

These were charged into a reaction vessel equipped with a stirrer and a thermometer under purging with nitrogen. Stirring was performed at 215° C. for 5 hours. After that, the temperature gradually rose to 230° C. under stirring and a reduced pressure, and this state was then maintained for 2 hours. After the product became viscous, it was air-cooled to terminate the reaction. Thus, an amorphous polyester 2 was obtained. The amorphous polyester 2 had a number-average molecular weight Mn of 12,000, a weight-average molecular weight Mw of 44,000, a Mw/Mn of 3.7, and a glass transition temperature Tg of 70.0° C.

<Synthesis Example of Block Polymer 1>

| | |
|---|---|
| xylylene diisocyanate (XDI) | 48.0 parts by mass |
| cyclohexanedimethanol (CHD | 27.0 parts by mass |
| tetrahydrofuran (THF) | 80.0 parts by mass |

These were charged into a reaction vessel equipped with a stirrer and a thermometer under purging with nitrogen. The solution was heated to 50° C. to cause a urethane reaction for 10 hours. After that, a solution in which 225.0 parts by mass of the crystalline polyester 1 was dissolved in 220.0 parts by mass of THF was gradually added and stirring was then performed at 50° C. for 5 hours. After that, cooling to room temperature was performed and THF serving as the solvent was evaporated. Thus, a block polymer 1 was synthesized. The physical properties of the block polymer 1 are described in Table 2.

<Synthesis Examples of Block Polymers 2 to 12>

Block polymers 2 to 12 were obtained as in the synthesis example of the block polymer 1 except that the type of a crystalline polyester and the amounts of the crystalline polyester, CHDM, and XDI charged were changed as described in Table 2. The physical properties of the block polymers 2 to 12 are described in Table 2.

<Synthesis Example of 2-methyl-2-[N-(tert-butyl)-N-(1-diethoxyphosphoryl-2,2-dimethylpropyl)-aminoxy]-propionic acid (MBPAP)>

| | |
|---|---|
| toluene | 500.0 parts by mass |
| CuBr | 36.0 parts by mass |
| copper powder | 16.0 parts by mass |
| N,N,N',N',N''-pentamethyldiethylenetriamine | 87.0 parts by mass |

These materials were charged into a reaction vessel equipped with a stirrer and a thermometer under purging with nitrogen and stirred at room temperature for 5 minutes. Subsequently,

| | |
|---|---|
| toluene | 580.0 parts by mass |
| 2-bromo-2-methylpropionic acid | 42.0 parts by mass |
| N-tert-butyl-N-(1-diethylphosphono-2,2-dimethylpropyl)nitroxide | 79.0 parts by mass |

were further charged and stirring was performed at room temperature for 90 minutes.

After that, the solvent was filtered off and the substance obtained by the filtration was washed twice with a $NH_4Cl$ saturated aqueous solution. The resultant solid was washed with pentane and subjected to vacuum drying to provide 2-methyl-2-[N-(tert-butyl)-N-(1-diethoxyphosphoryl-2,2-dimethylpropyl)-aminoxy]-propionic acid (MBPAP).

<Synthesis Example of Block Polymer 13>

| | |
|---|---|
| styrene monomer | 40.0 parts by mass |
| MBPAP | 3.0 parts by mass |

These were charged into a reaction vessel equipped with a stirrer and a thermometer under purging with nitrogen. Mixing was sufficiently performed at 80° C. under nitrogen flow and the temperature rose to 110° C. to polymerize styrene.

After that, 40.0 parts by mass of behenyl acrylate was added and the polymerization was continued at 130° C. to cause chain extension with behenyl acrylate. The polymerization product was dissolved in 100.0 parts by mass of THF and taken out and dropped in methanol to reprecipitate the compound. The precipitate was then filtered and subjected to repeated washing with methanol and then to vacuum drying at 40° C. Thus, a block polymer 13 of styrene and behenyl acrylate was obtained.

The block polymer 13 had a number-average molecular weight Mn of 25,000, a weight-average molecular weight Mw of 50,000, a Mw/Mn of 2.0, and a melting point of 65.0°

C.; and the proportion of a segment capable of forming a crystalline structure was 50.0% by mass.

<Synthesis Example of Block Polymer 14>

| | |
|---|---|
| crystalline polyester 1 | 40.0 parts by mass |
| amorphous polyester 2 | 40.0 parts by mass |
| tetrahydrofuran (THF) | 80.0 parts by mass |

These were charged into a reaction vessel equipped with a stirrer and a thermometer under purging with nitrogen. Mixing was sufficiently performed at 150° C. and then 0.5 parts by mass of dodecylbenzenesulfonic acid was added. The reaction was continued at this temperature under a reduced pressure of 0.5 kPa for 5 hours. After that, cooling to room temperature was performed and THF serving as the solvent was evaporated. Thus, a block polymer 14 was synthesized. The block polymer 14 had a number-average molecular weight Mn of 20,200, a weight-average molecular weight Mw of 45,000, a Mw/Mn of 2.2, and a melting point of 65.0° C.; and the proportion of a segment capable of forming a crystalline structure was 50.0% by mass.

<Synthesis Example of Polybehenyl Acrylate>

To a heat-dried two-necked flask, 300.0 parts by mass of toluene was charged under introduction of nitrogen. Subsequently, the following mixed solution was gradually added and stirring was further performed at 80° C. for 5 hours.

| | |
|---|---|
| behenyl acrylate | 100.0 parts by mass |
| toluene | 150.0 parts by mass |
| azobisisobutyronitrile | 10.0 parts by mass |

After that, reduction of the pressure was performed at 130° C. for 3 hours to evaporate toluene serving as the solvent. Thus, polybehenyl acrylate was synthesized. The polybehenyl acrylate had a number-average molecular weight Mn of 20,200, a weight-average molecular weight Mw of 45,000, a Mw/Mn of 2.2, and a melting point of 65.0° C.

<Synthesis Example of Vinyl-Based Monomer b1-1>

| | |
|---|---|
| crystalline polyester 6 | 100.0 parts by mass |
| tetrahydrofuran | 100.0 parts by mass |

These materials were charged into a reaction vessel equipped with a stirrer and a thermometer under purging with nitrogen, and dissolved at 40° C.

2-isocyanatoethyl methacrylate (6.2 parts by mass, Karenz MOI, manufactured by SHOWA DENKO K. K.) was dropped and the reaction was caused at 40° C. for 2 hours to provide the solution of a vinyl-based monomer b1-1. Subsequently, tetrahydrofuran was removed with a rotary evaporator under a reduced pressure at 40° C. for 5 hours. Thus, the vinyl-based monomer b1-1 was obtained.

<Synthesis Example of Vinyl-Based Monomer b1-2>

A vinyl-based monomer b1-2 was obtained by using the crystalline polyester 7 instead of the crystalline polyester 6 in the synthesis example of the vinyl-based monomer b1-1.

<Synthesis Example of Vinyl-Based Monomer b1-3>

A vinyl-based monomer b1-3 was obtained by using the crystalline polyester 8 instead of the crystalline polyester 6 in the synthesis example of the vinyl-based monomer b1-1.

<Synthesis Example of Shell Resin Dispersion Liquid 1>

| | |
|---|---|
| vinyl-based monomer b1-1 | 40.0 parts by mass |
| vinyl-based monomer having organic polysiloxane structure (X-22-2475, manufactured by Shin-Etsu Chemical Co., Ltd.) | 15.0 parts by mass |
| styrene (St) | 37.5 parts by mass |
| methacrylic acid (MAA) | 7.5 parts by mass |
| azobismethoxydimethylvaleronitrile | 0.3 parts by mass |
| normal hexane | 80.0 parts by mass |

These materials were charged into a reaction vessel equipped with a stirrer and a thermometer under purging with nitrogen. Stirring and mixing at 20° C. were performed to prepare a monomer solution. This monomer solution was introduced into a heat-dried dropping funnel. On the other hand, 300.0 parts by mass of normal hexane was charged into a heat-dried two-necked flask. Purging with nitrogen was performed and the dropping funnel was attached. In a sealed environment, the monomer solution was dropped at a reaction temperature of 40° C. over an hour. After the dropping was completed, stirring was continued for 3 hours; another dropping of a mixture of 0.3 parts by mass of azobismethoxydimethylvaleronitrile and 20.0 parts by mass of normal hexane was performed and stirring was performed at a reaction temperature of 40° C. for 3 hours. After that, cooling to room temperature was performed to provide a shell resin dispersion liquid 1 having a solid content of 20.0% by mass. The volume-average particle size of resin fine particles in the shell resin dispersion liquid 1 is described in Table 4. Note that X-22-2475, which is a vinyl-based monomer having an organic polysiloxane structure, is a vinyl-based monomer having a structure represented by the chemical formula (1) above where $R_1$ is a methyl group, $R_2$ is a methyl group, $R_3$ is a propylene group, $R_4$ is a methyl group, and n is 3.

Subsequently, a portion of the shell resin dispersion liquid 1 was evaporated with a rotary evaporator under a reduced pressure at 40° C. for 5 hours to provide a shell resin 1. The shell resin 1 was subjected to a DSC measurement and the peak temperature TpB of a maximum endothermic peak, a number-average molecular weight Mn, and a weight-average molecular weight Mw were measured. The results are described in Table 4.

<Synthesis Examples of Shell Resin Dispersion Liquids 2 to 29>

The synthesis example of the shell resin dispersion liquid 1 was performed, but the types and addition amounts of the vinyl-based monomer b1 and the vinyl-based monomer b2 and the reaction temperature were changed as described in Table 3. Thus, shell resin dispersion liquids 2 to 29 were obtained. The volume-average particle sizes of resin fine particles in the shell resin dispersion liquids 2 to 29 are described in Table 4.

In addition, shell resins 2 to 25 were similarly extracted from the shell resin dispersion liquids 2 to 29 and subjected to measurements of the maximum peak temperature TpB with DSC, a number-average molecular weight Mn, and a weight-average molecular weight Mw. The results are described in Table 4.

<Preparation Example of Shell Resin Dispersion Liquid 30>

| | |
|---|---|
| amorphous polyester 1 | 100.0 parts by mass |
| ionic surfactant NEOGEN RK (DAI-ICHI KOGYO SEIYAKU CO., LTD.) | 5.0 parts by mass |
| ion-exchanged water | 395.0 parts by mass |

These components were mixed, heated at 100° C., sufficiently dispersed with an ULTRA-TURRAX T50 manufactured by IKA Works GmbH & Co. KG, and was then subjected to a dispersion treatment with a pressure-jet Gaulin homogenizer for an hour. The obtained shell resin dispersion liquid 30 had a volume-average particle size of 180 nm and a solid content of 20.0% by mass.

Subsequently, a portion of the shell resin dispersion liquid 30 was filtered and dried under a reduced pressure for 5 hours to provide a shell resin 30.

<Preparation Example of Core Resin Solution 1>

| | |
|---|---|
| block polymer 1 | 100.0 parts by mass |
| acetone | 100.0 parts by mass |

These materials were charged into a beaker and stirred with a DISPER (manufactured by Tokushu Kika Kogyo Co., Ltd.) at a revolution speed of 3000 rpm for a minute to provide a core resin solution 1.

<Preparation Examples of Core Resin Solutions 2 to 19>

Core resin solutions 2 to 19 were obtained as in the preparation example of the core resin solution 1 except that the block polymer 1 was changed to materials, addition amounts, and solvents described in Table 5. Note that when two or more resins and solvents were used, these were charged together into beakers and stirred to prepare core resin solutions.

<Preparation Example of Wax Dispersion Liquid 1>

| | |
|---|---|
| dipentaerythritol palmitic acid ester wax | 20.0 parts by mass |
| wax dispersing agent (copolymer having a peak molecular weight of 8,500 and prepared by copolymerization of 50.0 parts by mass of styrene, 25.0 parts by mass of n-butyl acrylate, and 10.0 parts by mass of acrylonitrile in the presence of 15.0 parts by mass of polyethylene) | 10.0 parts by mass |
| acetone | 70.0 parts by mass |

These were charged into a glass beaker equipped with a stirring blade (manufactured by IWAKI glass). Within the system, the temperature rose to 50° C. so that the wax was dissolved in acetone. Within the system, gradual cooling was then performed to 25° C. over 3 hours under mild stirring at a revolution speed of 50 rpm. Thus, a milk-white liquid was obtained.

This solution was charged together with 20 parts by mass of glass beads having an average particle size of 1 mm into a heat-resistant vessel. Dispersion was performed with a paint shaker (manufactured by Toyo Seiki Seisaku-sho, Ltd.) for 3 hours. The glass beads were removed with a nylon mesh to provide a wax dispersion liquid 1 having a wax content of 20.0% by mass.

The particle size of the wax in the wax dispersion liquid 1 was 0.20 μm as a volume-average particle size.

<Preparation Example of Wax Dispersion Liquid 2>

A wax dispersion liquid 2 having a wax content of 20.0% by mass was obtained as in the preparation example of the wax dispersion liquid 1 except that acetone was changed to ethyl acetate.

The particle size of the wax in the wax dispersion liquid 2 was 0.20 μm as a volume-average particle size.

<Preparation of Wax Dispersion Liquid 3>

| | |
|---|---|
| dipentaerythritol palmitic acid ester wax | 20.0 parts by mass |
| cationic surfactant NEOGEN RK (DAI-ICHI KOGYO SEIYAKU CO., LTD.) | 10.0 parts by mass |
| ion-exchanged water | 70.0 parts by mass |

These were mixed, heated at 95° C., sufficiently dispersed with an ULTRA-TURRAX T50 manufactured by IKA Works GmbH & Co. KG, and was then subjected to a dispersion treatment with a pressure-jet Gaulin homogenizer. Thus, a wax dispersion liquid 3 having a wax content of 20.0% by mass was obtained.

The particle size of the wax in the wax dispersion liquid 3 was 0.20 μm as a volume-average particle size.

<Preparation Example of Colorant Dispersion Liquid 1>

| | |
|---|---|
| C.I. Pigment Blue 15:3 | 100.0 parts by mass |
| acetone | 150.0 parts by mass |
| glass beads (average particle size: 1 mm) | 200.0 parts by mass |

These materials were charged into a heat-resistant glass vessel. Dispersion was performed with a paint shaker for 5 hours. The glass beads were removed with a nylon mesh to provide a colorant dispersion liquid 1 having a solid content of 40.0% by mass. The colorant particles in the colorant dispersion liquid 1 had a volume-average particle size of 100 nm.

<Preparation Example of Colorant Dispersion Liquid 2>

A colorant dispersion liquid 2 having a solid content of 40.0% by mass was obtained as in the preparation example of the colorant dispersion liquid 1 except that acetone was changed to ethyl acetate. The colorant particles in the colorant dispersion liquid 2 had a volume-average particle size of 100 nm.

<Preparation Example of Colorant Dispersion Liquid 3>

| | |
|---|---|
| C.I. Pigment Blue 15:3 | 100.0 parts by mass |
| cationic surfactant NEOGEN RK (DAI-ICHI KOGYO SEIYAKU CO., LTD.) | 5.0 parts by mass |
| ion-exchanged water | 145.0 parts by mass |
| glass beads (average particle size: 1 mm) | 200.0 parts by mass |

These materials were charged into a heat-resistant glass vessel. Dispersion was performed with a paint shaker for 5 hours. The glass beads were removed with a nylon mesh to provide a colorant dispersion liquid 3 having a solid content of 40.0% by mass. The colorant particles in the colorant dispersion liquid 3 had a volume-average particle size of 100 nm.

<Production Example of Toner Particles 1>

In an apparatus illustrated in FIG. 1, valves V1 and V2 and a pressure control valve V3 were closed; a pressure-resistant particle-formation tank T1 equipped with a filter for capturing toner particles and a stirring mechanism was charged with 35.0 parts by mass of the shell resin dispersion liquid 1 and the internal temperature was adjusted to be 25° C. Subsequently, the valve V1 was opened and carbon dioxide (purity: 99.99%) was introduced from a cylinder B1 with a pump P1 into the pressure-resistant vessel T1. After the internal pressure reached 3.0 MPa, the valve V1 was closed.

On the other hand, to a resin dissolution liquid tank T2,

| | |
|---|---|
| core resin solution 1 | 180.0 parts by mass |
| wax dispersion liquid 1 | 25.0 parts by mass |
| colorant dispersion liquid 1 | 12.5 parts by mass |
| acetone | 15.0 parts by mass |
| carbon dioxide | 240.0 parts by mass |

were charged and the internal temperature was adjusted to be 25° C.

Subsequently, the valve V2 was opened; while stirring was performed at a revolution speed of 1000 rpm within the particle-formation tank T1, the content of the resin dissolution liquid tank T2 was introduced into the particle-formation tank T1 with a pump P2; after all the content was introduced, the valve V2 was closed. After the introduction, the internal pressure of the particle-formation tank T1 was 5.0 MPa. The mass of carbon dioxide having been introduced was measured with a mass flowmeter.

After the content of the resin dissolution liquid tank T2 was introduced into the particle-formation tank T1, stirring was further performed at a revolution speed of 2000 rpm for 10 minutes to form particles.

Subsequently, the valve V1 was opened and carbon dioxide was introduced from the cylinder B1 with the pump P1 into the particle-formation tank T1. At this time, the pressure control valve V3 was set to 10.0 MPa and while the internal pressure of the particle-formation tank T1 was maintained to be 10.0 MPa, carbon dioxide was further passed. As a result of this operation, carbon dioxide containing organic solvents (mainly acetone) extracted from droplets after particle formation was discharged to a solvent recovery tank T3 and separation between the organic solvents and carbon dioxide was performed.

The introduction of carbon dioxide into the particle-formation tank T1 was stopped when the introduction amount reached 15 times the mass of carbon dioxide initially introduced into the particle-formation tank T1. At this time, the operation of replacing carbon dioxide containing organic solvents with carbon dioxide not containing organic solvents was completed.

Furthermore, the pressure control valve V3 was gradually opened so that the internal pressure of the particle-formation tank T1 was reduced to the atmospheric pressure. Thus, toner particles 1 captured over the filter were collected. The toner particles 1 had a core-shell structure.

<Production Examples of Toner Particles 2 to 40 and 43 to 48>

Toner particles 2 to 40 and 43 to 48 were obtained as in the production example of the toner particles 1 except that the type of the shell resin solution and the amounts of the materials added were changed as described in Table 6. Note that the toner particles 2 to 40 and 43 to 48 each had a core-shell structure.

<Production Example of Toner Particles 41>

| | |
|---|---|
| core resin solution 19 | 180.0 parts by mass |
| wax dispersion liquid 2 | 25.0 parts by mass |
| colorant dispersion liquid 2 | 12.5 parts by mass |
| ethyl acetate | 15.0 parts by mass |

These materials were charged into a beaker, maintained to be 30° C., and stirred with a DISPER (manufactured by Tokushu Kika Kogyo Co., Ltd.) at a revolution speed of 6000 rpm for 3 minutes to prepare an oil phase 1.

| | |
|---|---|
| shell resin dispersion liquid 30 | 35.0 parts by mass |
| 50% aqueous solution of dodecyl diphenyl ether sodium disulfonate (ELEMINOL MON-7, manufactured by Sanyo Chemical Industries, Ltd.) | 30.0 parts by mass |
| 1 mass % aqueous solution of carboxymethylcellulose | 100.0 parts by mass |
| propylamine (manufactured by KANTO CHEMICAL CO., INC.) | 5.0 parts by mass |
| ion-exchanged water | 400.0 parts by mass |
| ethyl acetate | 50.0 parts by mass |

These materials were charged into a vessel and stirred with a TK HOMO MIXER (manufactured by Tokushu Kika Kogyo Co., Ltd.) at a revolution speed of 5000 rpm for a minute to prepare an aqueous phase 1.

The oil phase 1 was added to the aqueous phase 1 and stirred with the TK HOMO MIXER at an increased revolution speed of 10000 rpm for a minute to prepare a suspension of the oil phase 1. This suspension was subsequently stirred with a stirring blade at a revolution speed of 50 rpm for 30 minutes and then transferred into a 2 L recovery flask. While this flask was rotated at a revolution speed of 30 rpm with a rotary evaporator in a water bath at 25° C., nitrogen gas was blown to the liquid surface at a rate of 10 L/min for an hour. Thus, a toner particle dispersion liquid 41 was obtained.

An acid was added to the obtained toner particle dispersion liquid 41 such that the pH became 1.5. Subsequently, sufficient washing with ion-exchanged water was performed and then filter cake of toner particles 41 was obtained. This filter cake was dried with a vacuum dryer at room temperature for 3 days, sifted through a mesh having 75 μm openings, and subjected to air classification. Thus, the toner particles 41 were obtained. The toner particles 41 had a core-shell structure.

<Production Example of Toner Particles 42>

| | |
|---|---|
| core resin solution 14 | 400.0 parts by mass |
| anionic surfactant (sodium dodecylbenzenesulfonate) | 3.0 parts by mass |
| ion-exchanged water | 400.0 parts by mass |

These materials were mixed, heated to 40° C., and stirred with an emulsifier (ULTRA-TURRAX T50 manufactured by IKA Works GmbH & Co. KG) at a revolution speed of 8000 rpm for 10 minutes. After that, acetone was evaporated to prepare a core resin dispersion liquid 14.

| | |
|---|---|
| core resin dispersion liquid 14 | 360.0 parts by mass |
| colorant dispersion liquid 3 | 12.5 parts by mass |
| wax dispersion liquid 3 | 25.0 parts by mass |
| 10 mass % aqueous solution of polyaluminum chloride | 1.5 parts by mass |

These were mixed in a round stainless steel flask, mixed and dispersed with ULTRA-TURRAX T50 manufactured by IKA Works GmbH & Co. KG, and then held at 45° C. for 60 minutes under stirring. After that, 35.0 parts by mass of the shell resin dispersion liquid 30 was slowly added. The pH of the system was adjusted to be 6 with a 0.5 mol/L aqueous solution of sodium hydroxide. After that, the stainless steel flask was sealed; while stirring was continued with magnetic sealing, the temperature rose to 96° C. by heating and maintained for 5 hours.

After the reaction was completed, cooling, filtration, and sufficient washing with ion-exchanged water were performed to provide filter cake of toner particles 42. This filter cake was dried with a vacuum dryer at room temperature for 3 days, sifted through a mesh having 75 μm openings, and subjected to air classification. Thus, the toner particles 42 were obtained. The toner particles 42 had a core-shell structure.

<Production Example of Magnetic Carrier>

To each of a magnetite powder having a number-average particle size of 0.25 μm and a hematite powder having a number-average particle size of 0.60 μm, a silane-based coupling agent (3-(2-aminoethylaminopropyl)trimethoxysilane) was added at 4.0 mass %. In each vessel, high-speed mixing and stirring at 100° C. or more was performed to make the fine particles oleophilic.

| | |
|---|---|
| phenol | 10.0 parts by mass |
| formaldehyde solution (formaldehyde: 40 mass %; methanol: 10 mass %; water: 50 mass %) | 6.0 parts by mass |
| magnetite having been made oleophilic | 63.0 parts by mass |
| hematite having been made oleophilic | 21.0 parts by mass |

These materials, 5.0 parts by mass of 28 mass % aqueous ammonia, and 10.0 parts by mass of water were placed in a flask, heated to 85° C. over 30 minutes under stirring and mixing and maintained, and cured through polymerization reaction for 3 hours. After that, cooling to 30° C. was performed. Water was further added and the supernatant liquor was removed. The precipitate was washed with water and then air dried. Subsequently, the precipitate was dried at 60° C. under a reduced pressure (5 mmHg) to provide spherical magnetic resin particles in which the magnetic material is dispersed.

Subsequently, a coating resin was used that was a copolymer of methyl methacrylate and methyl methacrylate having a perfluoroalkyl group (copolymerization ratio on the mass basis (methyl methacrylate:methyl methacrylate having a perfluoroalkyl group=8:1, weight-average molecular weight Mw: 45,000). To 100.0 parts by mass of the coating resin, 10.0 parts by mass of melamine particles having a particle size of 290 nm and 6.0 parts by mass of carbon particles having a resistivity of $1\times10^{-2}$ Ω·cm and a particle size of 30 nm were added and dispersed with an ultrasonic dispersion system for 30 minutes. Furthermore, a coating solution (concentration of solution: 10.0% by mass) containing a solvent mixture of methyl ethyl ketone and toluene was prepared such that the amount of the coating resin with respect to the magnetic resin particles was 2.5 parts by mass.

This coating solution was used to resin-coat the surfaces of the magnetic resin particles in which shearing stress was continuously applied and the solvent was evaporated at 70° C. These resin-coated magnetic carrier particles were heat-treated under stirring at 100° C. for 2 hours, cooled, disintegrated, and then classified with 200-mesh screen to provide a magnetic carrier having number-average particle size of 33 μm, an absolute specific gravity of 3.53 g/cm$^3$, an apparent specific gravity of 1.84 g/cm$^3$, and a magnetization intensity of 42 Am$^2$/kg.

Example 1

Preparation of Toner 1 and Two-Component Developer 1

Subsequently, to 100 parts by mass of the toner particles 1, 0.9 parts by mass of an anatase-type titanium oxide fine powder (BET specific surface: 80 m$^2$/g; number-average particle size (D1): 15 nm; treated with isobutyltrimethoxysilane: 12% by mass) was externally added with a Henschel mixer; furthermore, 1.2 parts by mass of silicone oil treated silica fine particles (BET specific surface: 95 m$^2$/g; treated with silicone oil: 15% by mass) and 1.5 parts by mass of sol gel silica fine particles (BET specific surface: 24 m$^2$/g; number-average particle size (D1): 110 nm) were mixed with a Henschel mixer FM-10B (manufactured by Mitsui Miike Chemical Engineering Machinery, Co., Ltd.). Thus, a toner 1 was obtained. The physical properties of the toner 1 are described in Table 7.

In the present invention, a two-component developer 1 was prepared by mixing 8.0 parts by mass of the toner 1 and 92.0 parts by mass of the magnetic carrier. The obtained toner 1 and two-component developer 1 were subjected to various evaluations described below. The results are described in Table 8.

Examples 2 to 34

The toner particles 2 to 34 were subjected to the external addition treatment as in EXAMPLE 1 to provide toners 2 to 34. The physical properties of the toners 2 to 34 are described in Table 7. Two-component developers 2 to 34 were prepared by mixing 8.0 parts by mass of the toners 2 to 34 and 92.0 parts by mass of the magnetic carrier. The obtained toners 2 to 34 and two-component developers 2 to 34 were subjected to various evaluations. The results are described in Table 8.

Comparative Examples 1 to 11

The toner particles 35 to 45 were subjected to the external addition treatment as in EXAMPLE 1 to provide toners 35 to 45. The physical properties of the toners 35 to 45 are described in Table 7. Two-component developers 35 to 45 were prepared by mixing 8.0 parts by mass of the toners 35 to 45 and 92.0 parts by mass of the magnetic carrier. The obtained toners 35 to 45 and two-component developers 35 to 45 were subjected to various evaluations. The results are described in Table 8.

Reference Examples 1 to 3

The toner particles 46 to 48 were subjected to the external addition treatment as in EXAMPLE 1 to provide toners 46 to 48. The physical properties of the toners 46 to 48 are described in Table 7. Two-component developers 46 to 48 were prepared by mixing 8.0 parts by mass of the toners 46 to 48 and 92.0 parts by mass of the magnetic carrier. The obtained toners 46 to 48 and two-component developers 46 to 48 were subjected to various evaluations. The results are described in Table 8.

Hereinafter, evaluation methods for the obtained toners and two-component developers will be described.

<Evaluation of Low-Temperature Fixability>

The two-component developers 1 to 48 were evaluated with a color laser copier CLC500 (manufactured by CANON KABUSHIKI KAISHA) in the following manner. The development contrast of the copier was adjusted such that the toner coating amount on a paper sheet became 0.6/cm$^2$; a "solid" unfixed image, with a head margin of 5 mm, having a width of 100 mm and a length of 280 mm was formed in a single-color mode under an environment at normal temperature and normal humidity (temperature: 23.0° C.; relative humidity:

50%). The evaluation paper sheets were A4 paper sheets ("PLOVER BOND PAPER": 105 g/m$^2$, manufactured by Fox River Paper Company, LLC).

Subsequently, the fixing device of an LBP 5900 (manufactured by CANON KABUSHIKI KAISHA) was modified to allow manual setting of the fixing temperature. The process speed of the fixing device was changed to 300 mm/s. The pressure during fixing was set to be 1.00 kgf/cm$^2$. The modified fixing device was used and the fixing temperature rose in 5° C. increments in the range of 80° C. to 130° C. under an environment at normal temperature and normal humidity (temperature: 23° C.; relative humidity: 50%). Thus, the "solid" unfixed images were fixed at these temperatures.

The image region of each of the obtained fixed images was covered with a soft thin paper sheet (for example, product name "Dusper", manufactured by OZU CORPORATION). The image region was rubbed back and forth three times from above the thin paper sheet under a load of 1.0 KPa. The densities of the image before and after the rubbing were measured and a decrease ratio ΔD (%) in the image density was calculated by a formula described below. A temperature at which the ΔD (%) was less than 10% was defined as the fixing start temperature and the low-temperature fixability was evaluated in accordance with an evaluation system described below.

Note that the image density was measured with a Color reflection densitometer (X-Rite 404A, manufactured by X-Rite, Incorporated).

$$\Delta D(\%)=\{(\text{image density before rubbing}-\text{image density after rubbing})/\text{image density before rubbing}\}\times 100 \quad \text{(Formula):}$$

Note that ranks A to C were evaluated as good low-temperature fixability in the present invention.

Evaluation System

A: the fixing start temperature is less than 100° C.

B: the fixing start temperature is 100° C. or more and less than 110° C.

C: the fixing start temperature is 110° C. or more and less than 120° C.

D: the fixing start temperature is 120° C. or more

<Evaluation of Stress Resistance>

The toners 1 to 42 were evaluated in terms of durability with a commercially available CP4525dn (manufactured by Hewlett-Packard Company). In the CP4525dn (manufactured by Hewlett-Packard Company), one-component contact development is employed and the amount of the toner on a development carrier is regulated with a toner regulation member. A cartridge used for the evaluation was prepared: the toner of a commercially available cartridge was extracted; the inside of the cartridge was cleaned by air blowing; and the cartridge was then filled with 160 g of the above-described toner. This cartridge was attached to the cyan station and dummy cartridges were attached to the other stations and the evaluation was performed.

An image having a coverage rate of 1% was continuously output under an environment at a temperature of 30.0° C. and a relative humidity of 50% and under an environment at a temperature of 32.5° C. and a relative humidity of 50%. Thus, durability tests were each performed such that 8000 sheets were continuously output. After the durability tests, halftone images were output and visually inspected as to whether a vertical streak, what is called a development streak, due to fusion bonding of the toner onto the regulation member was generated or not. The evaluation paper sheets were A4 paper sheets ("GF-C": 81 g/m$^2$, manufactured by CANON KABUSHIKI KAISHA).

Note that ranks A to C were evaluated as having a high stress resistance in the present invention.

Evaluation System

A: no streaks on the image

B: observation of one or more and two or less development streaks

C: observation of three or more and six or less development streaks

D: observation of seven or more development streaks

<Evaluation of Ratio of Decrease in Toner Triboelectrification Amount Due to Continuous Shaking>

The toners 1 to 48 were evaluated in the following manner.

Into a plastic bottle, 1.0 g of a toner and 19.0 g of a magnetic carrier (The Imaging Society of Japan standard carrier, a spherical carrier (N-01) in which a ferrite core is surface-treated) were charged and left under an environment at normal temperature and normal humidity (temperature: 23° C.; relative humidity: 50%) for 24 hours. The magnetic carrier and the toner were charged into a plastic bottle having a lid and shaken with a shaker (YS-LD, manufactured by YAYOI CO., LTD.) for a minute at a speed of moving back and forth four times a second so that a two-component developer composed of the toner and the carrier was prepared and the toner was electrically charged.

Figure 2:
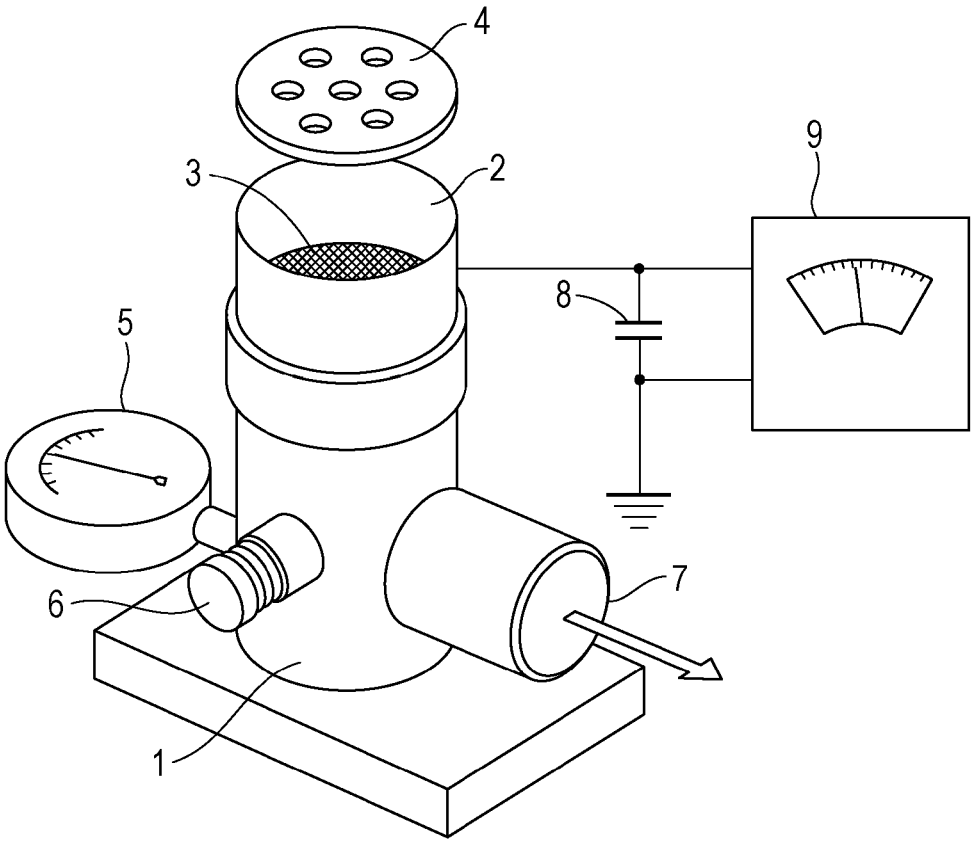
FIG. 2 is a schematic view of an instrument for measuring triboelectrification amount.
Figure 3:
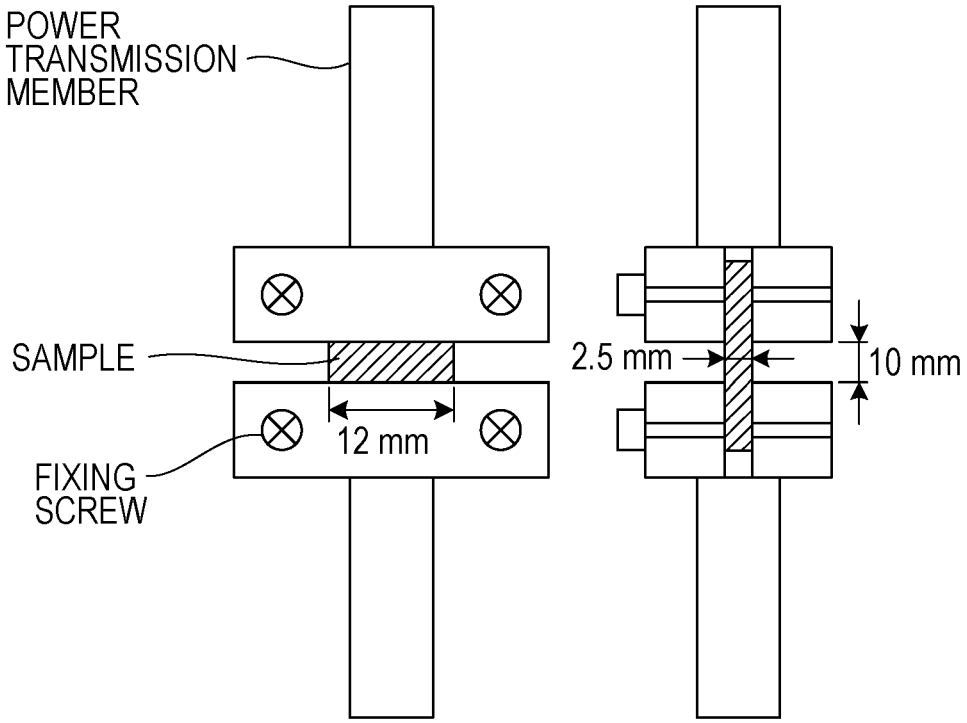
FIG. 3 is a schematic view of a measurement sample and a jig used in a viscoelastic measurement in the present invention.
Figure 4:
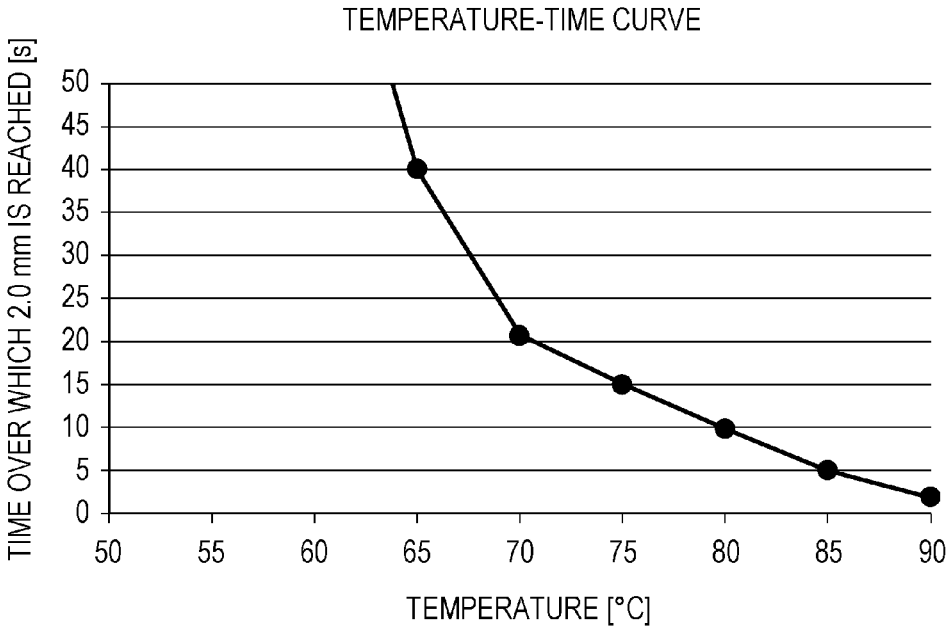
FIG. 4 is a temperature-time curve determined on the basis of a measurement of a toner in EXAMPLE 1 with a constant load extrusion-type capillary rheometer.

Subsequently, the triboelectrification amount was measured with the measurement instrument illustrated in FIG. 2. In FIG. 2, about 0.5 g of the two-component developer was charged into a metal measurement vessel 2 having a 500 mesh screen 3 at the bottom and the measurement vessel 2 was covered with a metal lid 4. At this time, the entire mass of the measurement vessel was weighed and defined as W1 (kg). Subsequently, in a suction apparatus 1 (at least the part that is in contact with the measurement vessel 2 is an insulating material), suctioning was performed through a suction port 7 and an air flow rate control valve 6 was controlled so that the pressure indicated by a vacuum gauge 5 was 2.5 kPa. In this state, suctioning was performed for 2 minutes to remove the toner from the developer by suction. At this time, the potential indicated by an electrometer 9 was defined as V (volts). Herein, the reference sign 8 denotes a capacitor and the capacity is defined as C (mF). After the suctioning, the entire mass of the measurement vessel was weighed and defined as W2 (g).

The triboelectrification amount Q(1) [mC/kg] of the sample having been shaken for a minute is calculated with the following formula (5).

$$Q(1)[mC/kg]=(C\times V)/(W1-W2) \quad (5)$$

Similarly, the triboelectrification amount Q(30) in the case of shaking for 30 minutes at a speed of moving back and forth four times a second was also measured. The ratio of a decrease in the triboelectrification amount in the present invention can be calculated with the following formula.

$$\text{(Ratio of decrease in triboelectrification amount)(\%)}=\{(Q(1)-Q(30))/Q(1)\}\times 100 \quad (6)$$

In this evaluation, the ratio of a decrease in the triboelectrification amount indicates the degree of degradation of the toner due to rubbing against the magnetic carrier. It is considered that, the lower the decrease ratio, the higher the stress resistance. Specifically, ranks A to C were evaluated as having high chargeability in the present invention.

Evaluation system in terms of ratio of decrease in triboelectrification amount

A: the ratio of a decrease in the triboelectrification amount is less than 10%

B: the ratio of a decrease in the triboelectrification amount is 10% or more and less than 15%

C: the ratio of a decrease in the triboelectrification amount is 15% or more and less than 20%

D: the ratio of a decrease in the triboelectrification amount is 20% or more

TABLE 1

| | Acid component [parts by mass] | | | Alcohol component [parts by mass] | | | Molecular weight | | | Peak temperature |
|---|---|---|---|---|---|---|---|---|---|---|
| | sebacic acid | adipic acid | 1,16-hexadecane dicarboxylic acid | 1,4-butanediol | 1,6-hexanediol | 1,9-nonanediol | Number-average molecular weight Mn | Weight-average molecular weight Mw | Mw/Mn | of maximum endothermic peak [° C.] |
| Crystalline polyester 1 | 124.0 | — | — | — | 76.0 | — | 4800 | 11800 | 2.5 | 73.0 |
| Crystalline polyester 2 | 136.2 | — | — | 63.8 | — | — | 5100 | 11500 | 2.3 | 66.0 |
| Crystalline polyester 3 | 108.5 | — | — | — | — | 91.5 | 5200 | 11600 | 2.2 | 75.0 |
| Crystalline polyester 4 | 111.7 | 21.9 | — | 66.4 | — | — | 5000 | 11600 | 2.3 | 61.0 |
| Crystalline polyester 5 | — | — | 152.9 | 47.1 | — | — | 5000 | 11200 | 2.2 | 83.0 |
| Crystalline polyester 6 | 134.0 | — | — | 66.0 | — | — | 2500 | 4500 | 1.8 | 66.0 |
| Crystalline polyester 7 | 105.5 | — | — | — | — | 94.5 | 2600 | 4800 | 1.8 | 75.0 |
| Crystalline polyester 8 | — | — | 150.0 | 50.0 | — | — | 2400 | 4400 | 1.8 | 83.0 |

TABLE 2

| | Crystalline polyester | | CHDM | XDI | Proportion of | | | | |
|---|---|---|---|---|---|---|---|---|---|
| | Type | Addition amount [parts by mass] | Addition amount [parts by mass] | Addition amount [parts by mass] | segment capable of forming crystalline structure [%] | Molecular weight Mn | Mw | Mw/Mn | Peak temperature TpA of maximum endothermic peak [° C.] |
| Block polymer 1 | Crystalline polyester 1 | 225.0 | 27.0 | 48.0 | 75% | 14400 | 31200 | 2.2 | 65.0 |
| Block polymer 2 | Crystalline polyester 2 | 195.0 | 41.0 | 64.0 | 65% | 17200 | 36800 | 2.1 | 58.0 |
| Block polymer 3 | Crystalline polyester 3 | 225.0 | 27.0 | 48.0 | 75% | 12300 | 31300 | 2.5 | 67.0 |
| Block polymer 4 | Crystalline polyester 4 | 165.0 | 54.0 | 81.0 | 55% | 13200 | 29500 | 2.2 | 53.0 |
| Block polymer 5 | Crystalline polyester 4 | 147.0 | 62.0 | 91.0 | 49% | 12500 | 29000 | 2.3 | 53.0 |
| Block polymer 6 | Crystalline polyester 5 | 267.0 | 8.0 | 25.0 | 89% | 12000 | 28000 | 2.3 | 73.0 |
| Block polymer 7 | Crystalline polyester 5 | 273.0 | 6.0 | 21.0 | 91% | 19400 | 40500 | 2.1 | 73.0 |
| Block polymer 8 | Crystalline polyester 1 | 213.0 | 33.0 | 54.0 | 71% | 21900 | 41000 | 1.9 | 65.0 |
| Block polymer 9 | Crystalline polyester 1 | 237.0 | 22.0 | 41.0 | 79% | 18800 | 39000 | 2.1 | 65.0 |
| Block polymer 10 | Crystalline polyester 1 | 255.0 | 13.0 | 32.0 | 85% | 11200 | 29800 | 2.7 | 65.0 |
| Block polymer 11 | Crystalline polyester 1 | 201.0 | 38.0 | 61.0 | 67% | 11600 | 27000 | 2.3 | 65.0 |
| Block polymer 12 | Crystalline polyester 2 | 210.0 | 34.0 | 56.0 | 70% | 14600 | 31000 | 2.1 | 58.0 |

TABLE 3

| | Vinyl-based monomer b1 | | Vinyl-based monomer b2 | | | | | | |
|---|---|---|---|---|---|---|---|---|---|
| | Type | Addition amount [parts by mass] | styrene [parts by mass] | stearyl acrylate [parts by mass] | behenyl acrylate [parts by mass] | methyl meth-acrylate [parts by mass] | methacrylic acid [parts by mass] | Vinyl-based monomer having organic polysiloxane structure (parts by mass) | Reac-tion temper-ature [° C.] |
| Shell resin dispersion liquid 1 | Vinyl-based monomer b1-1 | 40.0 | 37.5 | — | — | — | 7.5 | 15.0 | 40.0 |
| Shell resin dispersion liquid 2 | Vinyl-based monomer b1-1 | 40.0 | 37.5 | — | — | — | 7.5 | 15.0 | 45.0 |
| Shell resin dispersion liquid 3 | Vinyl-based monomer b1-1 | 21.0 | 49.0 | — | — | — | 15.0 | 15.0 | 40.0 |
| Shell resin dispersion liquid 4 | Vinyl-based monomer b1-1 | 49.0 | 21.0 | — | — | — | 15.0 | 15.0 | 40.0 |
| Shell resin dispersion liquid 5 | Vinyl-based monomer b1-1 | 19.0 | 51.0 | — | — | — | 15.0 | 15.0 | 40.0 |
| Shell resin dispersion liquid 6 | Vinyl-based monomer b1-1 | 51.0 | 19.0 | — | — | — | 15.0 | 15.0 | 40.0 |
| Shell resin dispersion liquid 7 | Vinyl-based monomer b1-1 | 40.0 | 42.0 | — | — | — | 3.0 | 15.0 | 40.0 |
| Shell resin dispersion liquid 8 | Vinyl-based monomer b1-1 | 40.0 | 30.0 | — | — | — | 15.0 | 15.0 | 40.0 |
| Shell resin dispersion liquid 9 | Vinyl-based monomer b1-1 | 65.0 | 15.0 | — | — | — | 5.0 | 15.0 | 40.0 |
| Shell resin dispersion liquid 10 | Vinyl-based monomer b1-1 | 40.0 | 35.0 | — | — | — | 10.0 | 15.0 | 40.0 |
| Shell resin dispersion liquid 11 | Vinyl-based monomer b1-1 | 80.0 | 2.0 | — | — | — | 3.0 | 15.0 | 40.0 |
| Shell resin dispersion liquid 12 | Vinyl-based monomer b1-1 | 50.0 | 27.5 | — | — | — | 7.5 | 15.0 | 40.0 |
| Shell resin dispersion liquid 13 | Vinyl-based monomer b1-1 | 30.0 | 52.0 | — | — | — | 3.0 | 15.0 | 40.0 |
| Shell resin dispersion liquid 14 | Vinyl-based monomer b1-1 | 40.0 | 42.0 | — | — | — | 3.0 | 15.0 | 37.0 |
| Shell resin dispersion liquid 15 | Vinyl-based monomer b1-1 | 85.0 | — | — | — | — | 5.0 | 10.0 | 40.0 |
| Shell resin dispersion liquid 16 | Vinyl-based monomer b1-1 | 10.0 | 55.0 | — | — | — | 20.0 | 15.0 | 40.0 |
| Shell resin dispersion liquid 17 | Vinyl-based monomer b1-1 | 40.0 | 47.5 | — | — | — | 7.5 | 5.0 | 40.0 |
| Shell resin dispersion liquid 18 | Vinyl-based monomer b1-1 | 40.0 | 32.5 | — | — | — | 7.5 | 20.0 | 40.0 |
| Shell resin dispersion liquid 19 | Vinyl-based monomer b1-1 | 40.0 | 48.5 | — | — | — | 7.5 | 4.0 | 40.0 |
| Shell resin dispersion liquid 20 | Vinyl-based monomer b1-1 | 40.0 | 31.5 | — | — | — | 7.5 | 21.0 | 40.0 |
| Shell resin dispersion liquid 21 | Vinyl-based monomer b1-1 | 40.0 | 37.5 | — | — | 7.5 | — | 15.0 | 40.0 |
| Shell resin dispersion liquid 22 | Vinyl-based monomer b1-2 | 10.0 | 65.0 | — | — | — | 10.0 | 15.0 | 40.0 |
| Shell resin dispersion liquid 23 | Vinyl-based monomer b1-1 | 40.0 | 43.0 | — | — | — | 2.0 | 15.0 | 40.0 |
| Shell resin dispersion liquid 24 | Vinyl-based monomer b1-1 | 40.0 | 29.0 | — | — | — | 16.0 | 15.0 | 40.0 |
| Shell resin dispersion liquid 25 | — | — | 37.5 | — | 40.0 | — | 7.5 | 15.0 | 40.0 |
| Shell resin dispersion liquid 26 | Vinyl-based monomer b1-1 | 70.0 | — | — | — | — | 15.0 | 15.0 | 40.0 |
| Shell resin dispersion liquid 27 | — | — | 40.0 | 50.0 | — | — | 10.0 | — | 40.0 |
| Shell resin dispersion liquid 28 | — | — | — | — | 53.0 | — | 20.0 | 27.0 | 40.0 |
| Shell resin dispersion liquid 29 | Vinyl-based monomer b1-3 | 10.0 | 65.0 | — | — | — | 10.0 | 15.0 | 40.0 |

TABLE 4

| | | Volume-average | Molecular weight | | |
|---|---|---|---|---|---|
| Type of resin B | TpB [° C.] | particle size of resin fine particles [nm] | Number-average molecular weight Mn | Weight-average molecular weight Mw | Mw/Mn |
| Shell resin 1 | 65.0 | 155 | 14000 | 70000 | 5.0 |
| Shell resin 2 | 65.0 | 160 | 10000 | 50000 | 5.0 |
| Shell resin 3 | 65.0 | 155 | 21000 | 105000 | 5.0 |
| Shell resin 4 | 65.0 | 160 | 22000 | 102000 | 4.6 |
| Shell resin 5 | 65.0 | 140 | 20500 | 103000 | 5.0 |
| Shell resin 6 | 65.0 | 145 | 21500 | 110000 | 5.1 |
| Shell resin 7 | 65.0 | 145 | 13800 | 71000 | 5.1 |
| Shell resin 8 | 65.0 | 155 | 15600 | 69000 | 4.4 |
| Shell resin 9 | 65.0 | 150 | 10500 | 41000 | 3.9 |
| Shell resin 10 | 65.0 | 180 | 29500 | 103000 | 3.5 |
| Shell resin 11 | 65.0 | 190 | 13000 | 31000 | 2.4 |
| Shell resin 12 | 65.0 | 120 | 55000 | 310000 | 5.6 |
| Shell resin 13 | 65.0 | 155 | 95000 | 490000 | 5.2 |
| Shell resin 14 | 65.0 | 155 | 21500 | 103000 | 4.8 |
| Shell resin 15 | 65.0 | 190 | 12000 | 29500 | 2.5 |
| Shell resin 16 | 65.0 | 170 | 20500 | 70500 | 3.4 |
| Shell resin 17 | 65.0 | 160 | 20700 | 71500 | 3.5 |
| Shell resin 18 | 65.0 | 155 | 22000 | 72200 | 3.3 |
| Shell resin 19 | 65.0 | 160 | 21500 | 69500 | 3.2 |
| Shell resin 20 | 65.0 | 146 | 21800 | 70700 | 3.2 |
| Shell resin 21 | 65.0 | 148 | 21600 | 70200 | 3.3 |
| Shell resin 22 | 75.0 | 142 | 46000 | 200000 | 4.3 |
| Shell resin 23 | 65.0 | 145 | 22000 | 70300 | 3.2 |
| Shell resin 24 | 65.0 | 151 | 21500 | 70500 | 3.3 |
| Shell resin 25 | 55.0 | 152 | 20700 | 70500 | 3.4 |
| Shell resin 26 | 65.0 | 153 | 21500 | 70800 | 3.3 |
| Shell resin 27 | 50.0 | 155 | 63000 | 300000 | 4.8 |

TABLE 4-continued

| Type of resin B | TpB [° C.] | Volume-average particle size of resin fine particles [nm] | Molecular weight Number-average molecular weight Mn | Weight-average molecular weight Mw | Mw/Mn |
|---|---|---|---|---|---|
| Shell resin 28 | 55.0 | 155 | 17500 | 52000 | 3.0 |
| Shell resin 29 | 83.0 | 160 | 45000 | 200000 | 4.4 |

TABLE 5

| | Resin 1 | Addition amount (parts by mass) | Resin 2 | Addition amount (parts by mass) | Solvent 1 | Addition amount (parts by mass) | Solvent 2 | Addition amount (parts by mass) |
|---|---|---|---|---|---|---|---|---|
| Core resin solution 1 | Block polymer 1 | 100.0 | — | — | acetone | 100.0 | — | — |
| Core resin solution 2 | Block polymer 2 | 100.0 | — | — | acetone | 100.0 | — | — |
| Core resin solution 3 | Block polymer 3 | 100.0 | — | — | acetone | 100.0 | — | — |
| Core resin solution 4 | Block polymer 4 | 100.0 | — | — | acetone | 100.0 | — | — |
| Core resin solution 5 | Block polymer 5 | 100.0 | — | — | acetone | 100.0 | — | — |
| Core resin solution 6 | Block polymer 6 | 100.0 | — | — | acetone | 100.0 | — | — |
| Core resin solution 7 | Block polymer 7 | 100.0 | — | — | acetone | 100.0 | — | — |
| Core resin solution 8 | Block polymer 8 | 100.0 | — | — | acetone | 100.0 | — | — |
| Core resin solution 9 | Block polymer 9 | 100.0 | — | — | acetone | 100.0 | — | — |
| Core resin solution 10 | Block polymer 10 | 100.0 | — | — | acetone | 100.0 | — | — |
| Core resin solution 11 | Block polymer 11 | 100.0 | — | — | acetone | 100.0 | — | — |
| Core resin solution 12 | Block polymer 12 | 100.0 | — | — | acetone | 100.0 | — | — |
| Core resin solution 13 | Crystalline polyester 1 | 50.0 | Amorphous polyurethane 1 | 50.0 | acetone | 100.0 | — | — |
| Core resin solution 14 | Amorphous polyester 1 | 100.0 | — | — | acetone | 100.0 | — | — |
| Core resin solution 15 | Block polymer 13 | 100.0 | — | — | acetone | 100.0 | — | — |
| Core resin solution 16 | Block polymer 14 | 100.0 | — | — | acetone | 100.0 | — | — |
| Core resin solution 17 | polybehenyl acrylate | 100.0 | — | — | toluene | 100.0 | — | — |
| Core resin solution 18 | Crystalline polyester 1 | 80.0 | Amorphous polyurethane 1 | 20.0 | acetone | 100.0 | — | — |
| Core resin solution 19 | Block polymer 1 | 100.0 | — | — | 2-butanone | 50.0 | ethyl acetate | 50.0 |

TABLE 6

| | Core resin solution/ core resin dispersion liquid | | Shell resin dispersion liquid | | Colorant dispersion liquid | | Wax dispersion liquid | |
|---|---|---|---|---|---|---|---|---|
| | Type | Addition amount [parts by mass] | Type | Addition amount [parts by mass] | Type | Addition amount [parts by mass] | Type | Addition amount [parts by mass] |
| Tp 1 | Crs 1 | 180.0 | Srdl 1 | 35.0 | Cdl 1 | 12.5 | Wdl 1 | 25.0 |
| Tp 2 | Crs 2 | 180.0 | Srdl 1 | 35.0 | Cdl 1 | 12.5 | Wdl 1 | 25.0 |
| Tp 3 | Crs 3 | 180.0 | Srdl 1 | 35.0 | Cdl 1 | 12.5 | Wdl 1 | 25.0 |
| Tp 4 | Crs 4 | 180.0 | Srdl 2 | 35.0 | Cdl 1 | 12.5 | Wdl 1 | 25.0 |
| Tp 5 | Crs 5 | 180.0 | Srdl 2 | 35.0 | Cdl 1 | 12.5 | Wdl 1 | 25.0 |
| Tp 6 | Crs 6 | 180.0 | Srdl 2 | 35.0 | Cdl 1 | 12.5 | Wdl 1 | 25.0 |
| Tp 7 | Crs 7 | 180.0 | Srdl 2 | 35.0 | Cdl 1 | 12.5 | Wdl 1 | 25.0 |
| Tp 8 | Crs 1 | 180.0 | Srdl 3 | 35.0 | Cdl 1 | 12.5 | Wdl 1 | 25.0 |
| Tp 9 | Crs 1 | 180.0 | Srdl 4 | 35.0 | Cdl 1 | 12.5 | Wdl 1 | 25.0 |
| Tp 10 | Crs 1 | 180.0 | Srdl 5 | 35.0 | Cdl 1 | 12.5 | Wdl 1 | 25.0 |
| Tp 11 | Crs 1 | 180.0 | Srdl 6 | 35.0 | Cdl 1 | 12.5 | Wdl 1 | 25.0 |
| Tp 12 | Crs 8 | 180.0 | Srdl 7 | 35.0 | Cdl 1 | 12.5 | Wdl 1 | 25.0 |
| Tp 13 | Crs 8 | 180.0 | Srdl 8 | 35.0 | Cdl 1 | 12.5 | Wdl 1 | 25.0 |
| Tp 14 | Crs 9 | 180.0 | Srdl 9 | 35.0 | Cdl 1 | 12.5 | Wdl 1 | 25.0 |
| Tp 15 | Crs 10 | 180.0 | Srdl 10 | 35.0 | Cdl 1 | 12.5 | Wdl 1 | 25.0 |
| Tp 16 | Crs 11 | 180.0 | Srdl 11 | 35.0 | Cdl 1 | 12.5 | Wdl 1 | 25.0 |
| Tp 17 | Crs 8 | 180.0 | Srdl 12 | 35.0 | Cdl 1 | 12.5 | Wdl 1 | 25.0 |
| Tp 18 | Crs 1 | 180.0 | Srdl 13 | 35.0 | Cdl 1 | 12.5 | Wdl 1 | 25.0 |
| Tp 19 | Crs 11 | 180.0 | Srdl 1 | 35.0 | Cdl 1 | 12.5 | Wdl 1 | 25.0 |
| Tp 20 | Crs 10 | 180.0 | Srdl 14 | 35.0 | Cdl 1 | 12.5 | Wdl 1 | 25.0 |
| Tp 21 | Crs 1 | 180.0 | Srdl 15 | 35.0 | Cdl 1 | 12.5 | Wdl 1 | 25.0 |
| Tp 22 | Crs 1 | 180.0 | Srdl 16 | 35.0 | Cdl 1 | 12.5 | Wdl 1 | 25.0 |
| Tp 23 | Crs 1 | 180.0 | Srdl 17 | 35.0 | Cdl 1 | 12.5 | Wdl 1 | 25.0 |
| Tp 24 | Crs 1 | 180.0 | Srdl 18 | 35.0 | Cdl 1 | 12.5 | Wdl 1 | 25.0 |
| Tp 25 | Crs 1 | 180.0 | Srdl 19 | 35.0 | Cdl 1 | 12.5 | Wdl 1 | 25.0 |
| Tp 26 | Crs 1 | 180.0 | Srdl 20 | 35.0 | Cdl 1 | 12.5 | Wdl 1 | 25.0 |
| Tp 27 | Crs 1 | 195.0 | Srdl 1 | 17.0 | Cdl 1 | 13.5 | Wdl 1 | 27.0 |
| Tp 28 | Crs 1 | 156.0 | Srdl 1 | 64.0 | Cdl 1 | 11.0 | Wdl 1 | 21.5 |

TABLE 6-continued

| | Core resin solution/ core resin dispersion liquid | | Shell resin dispersion liquid | | Colorant dispersion liquid | | Wax dispersion liquid | |
|---|---|---|---|---|---|---|---|---|
| | Type | Addition amount [parts by mass] | Type | Addition amount [parts by mass] | Type | Addition amount [parts by mass] | Type | Addition amount [parts by mass] |
| Tp 29 | Crs 1 | 180.0 | Srdl 1 | 35.0 | Cdl 1 | 12.5 | Wdl 1 | 25.0 |
| Tp 30 | Crs 1 | 180.0 | Srdl 21 | 35.0 | Cdl 1 | 12.5 | Wdl 1 | 25.0 |
| Tp 31 | Crs 16 | 180.0 | Srdl 16 | 35.0 | Cdl 1 | 12.5 | Wdl 1 | 25.0 |
| Tp 32 | Crs 1 | 180.0 | Srdl 22 | 35.0 | Cdl 1 | 12.5 | Wdl 1 | 25.0 |
| Tp 33 | Crs 8 | 180.0 | Srdl 23 | 35.0 | Cdl 1 | 12.5 | Wdl 1 | 25.0 |
| Tp 34 | Crs 8 | 180.0 | Srdl 24 | 35.0 | Cdl 1 | 12.5 | Wdl 1 | 25.0 |
| Tp 35 | Crs 1 | 180.0 | Srdl 25 | 35.0 | Cdl 1 | 12.5 | Wdl 1 | 25.0 |
| Tp 36 | Crs 1 | 180.0 | Srdl 26 | 35.0 | Cdl 1 | 12.5 | Wdl 1 | 25.0 |
| Tp 37 | Crs 1 | 180.0 | Srdl 27 | 35.0 | Cdl 1 | 12.5 | Wdl 1 | 25.0 |
| Tp 38 | Crs 1 | 180.0 | Srdl 28 | 35.0 | Cdl 1 | 12.5 | Wdl 1 | 25.0 |
| Tp 39 | Crs 13 | 180.0 | Srdl 1 | 35.0 | Cdl 1 | 12.5 | Wdl 1 | 25.0 |
| Tp 40 | Crs 14 | 180.0 | Srdl 7 | 35.0 | Cdl 1 | 12.5 | Wdl 1 | 25.0 |
| Tp 41 | Crs 19 | 180.0 | Srdl 30 | 35.0 | Cdl 2 | 12.5 | Wdl 2 | 25.0 |
| Tp 42 | Core resin dispersion liquid 14 | 360.0 | Srdl 30 | 35.0 | Cdl 3 | 12.5 | Wdl 3 | 25.0 |
| Tp 43 | Crs 15 | 180.0 | Srdl 1 | 35.0 | Cdl 1 | 12.5 | Wdl 1 | 25.0 |
| Tp 44 | Crs 16 | 180.0 | Srdl 1 | 35.0 | Cdl 1 | 12.5 | Wdl 1 | 25.0 |
| Tp 45 | Crs 17 | 180.0 | Srdl 1 | 35.0 | Cdl 1 | 12.5 | Wdl 1 | 25.0 |
| Tp 46 | Crs 12 | 180.0 | Srdl 1 | 35.0 | Cdl 1 | 12.5 | Wdl 1 | 25.0 |
| Tp 47 | Crs 1 | 180.0 | Srdl 29 | 35.0 | Cdl 1 | 12.5 | Wdl 1 | 25.0 |
| Tp 48 | Crs 18 | 180.0 | Srdl 1 | 35.0 | Cdl 1 | 12.5 | Wdl 1 | 25.0 |

"Tp" represents Toner particles.
"Crs" represents Core resin solution.
"Srdl" represents Shell resin dispersion liquid.
"Cdl" represents Colorant dispersion liquid.
"Wdl" represents Wax dispersion liquid.
Note that the toner particles 1 to 48 each had a core-shell structure.

TABLE 7

| | T(5) [° C.] | t(1) [s] | t(5) [s] | t(1)/ t(5) | Toner particle size and particle size distribution D4 [μm] | D1 μm] | D4/D1 | Molecular weight of THF-soluble matter of toner Mn | Mw | Mw/Mn | Peak temperature Tp of maximum endothermic peak of toner [° C.] | True density ρ of toner [g/cm$^3$] |
|---|---|---|---|---|---|---|---|---|---|---|---|---|
| T 1 | 79.2 | 151.9 | 20.7 | 7.3 | 6.6 | 5.8 | 1.14 | 19500 | 41300 | 2.1 | 65.0 | 1.19 |
| T 2 | 71.2 | 96.4 | 11.7 | 8.2 | 6.5 | 5.9 | 1.10 | 22200 | 46800 | 2.1 | 58.0 | 1.19 |
| T 3 | 85.2 | 188.9 | 26.7 | 7.1 | 6.4 | 5.8 | 1.10 | 17300 | 41300 | 2.4 | 67.0 | 1.18 |
| T 4 | 69.1 | 71.4 | 8.3 | 8.6 | 6.3 | 5.7 | 1.11 | 18200 | 39500 | 2.2 | 53.0 | 1.19 |
| T 5 | 76.9 | 115.8 | 15.5 | 7.5 | 6.5 | 5.9 | 1.10 | 17500 | 39000 | 2.2 | 53.0 | 1.18 |
| T 6 | 84.9 | 189.8 | 27.5 | 6.9 | 6.2 | 5.9 | 1.05 | 17000 | 38000 | 2.2 | 73.0 | 1.19 |
| T 7 | 82.3 | 175.0 | 25.1 | 7.0 | 6.5 | 6.1 | 1.07 | 23200 | 48200 | 2.1 | 73.0 | 1.20 |
| T 8 | 79.5 | 218.8 | 25.2 | 8.7 | 6.5 | 5.3 | 1.23 | 19300 | 41100 | 2.1 | 65.0 | 1.18 |
| T 9 | 79.4 | 182.1 | 22.7 | 8.0 | 6.7 | 5.7 | 1.18 | 18900 | 41000 | 2.2 | 65.0 | 1.17 |
| T 10 | 79.5 | 221.4 | 25.4 | 8.7 | 6.5 | 5.8 | 1.12 | 19500 | 41300 | 2.1 | 65.0 | 1.18 |
| T 11 | 79.4 | 179.4 | 22.6 | 8.0 | 6.2 | 5.6 | 1.11 | 19600 | 41400 | 2.1 | 65.0 | 1.19 |
| T 12 | 84.2 | 162.2 | 24.2 | 6.7 | 6.5 | 5.9 | 1.10 | 22500 | 47300 | 2.1 | 65.0 | 1.19 |
| T 13 | 84.5 | 213.7 | 27.7 | 7.7 | 6.4 | 5.9 | 1.08 | 24500 | 48000 | 2.0 | 65.0 | 1.18 |
| T 14 | 73.6 | 69.0 | 12.4 | 5.6 | 7.2 | 5.5 | 1.31 | 17300 | 41000 | 2.4 | 65.0 | 1.17 |
| T 15 | 66.3 | 98.4 | 10.1 | 9.7 | 6.7 | 4.9 | 1.37 | 16200 | 39800 | 2.5 | 65.0 | 1.18 |
| T 16 | 87.7 | 118.9 | 23.5 | 5.1 | 6.5 | 5.6 | 1.16 | 16600 | 37000 | 2.2 | 65.0 | 1.19 |
| T 17 | 85.0 | 243.3 | 29.6 | 8.2 | 6.3 | 5.2 | 1.21 | 23400 | 47500 | 2.0 | 65.0 | 1.17 |
| T 18 | 80.1 | 285.8 | 29.7 | 9.6 | 6.2 | 5.2 | 1.19 | 19400 | 41200 | 2.1 | 65.0 | 1.16 |
| T 19 | 88.3 | 203.7 | 29.1 | 7.0 | 6.5 | 5.4 | 1.20 | 16600 | 37000 | 2.2 | 65.0 | 1.17 |
| T 20 | 67.5 | 75.8 | 9.3 | 8.2 | 6.5 | 5.5 | 1.18 | 16200 | 39800 | 2.5 | 65.0 | 1.19 |
| T 21 | 78.6 | 69.1 | 15.2 | 4.5 | 6.6 | 5.2 | 1.27 | 18400 | 40200 | 2.2 | 65.0 | 1.19 |
| T 22 | 79.5 | 244.9 | 26.9 | 9.1 | 6.4 | 5.6 | 1.14 | 19400 | 41200 | 2.1 | 65.0 | 1.18 |
| T 23 | 79.2 | 124.9 | 21.0 | 5.9 | 6.5 | 5.5 | 1.18 | 19600 | 41400 | 2.1 | 65.0 | 1.19 |
| T 24 | 79.2 | 126.0 | 22.5 | 5.6 | 6.5 | 5.9 | 1.10 | 19800 | 41500 | 2.1 | 65.0 | 1.18 |
| T 25 | 79.2 | 126.0 | 19.0 | 6.6 | 6.7 | 5.5 | 1.22 | 19300 | 41700 | 2.2 | 65.0 | 1.19 |
| T 26 | 79.2 | 127.0 | 25.0 | 5.1 | 6.6 | 5.6 | 1.18 | 19200 | 41800 | 2.2 | 65.0 | 1.15 |
| T 27 | 79.2 | 130.0 | 23.7 | 5.5 | 6.5 | 5.3 | 1.23 | 19800 | 41700 | 2.1 | 65.0 | 1.16 |
| T 28 | 79.2 | 150.0 | 21.0 | 7.1 | 6.5 | 5.6 | 1.16 | 19500 | 41800 | 2.1 | 65.0 | 1.17 |
| T 29 | 79.1 | 132.2 | 19.4 | 6.8 | 6.5 | 5.1 | 1.27 | 19500 | 41800 | 2.1 | 65.0 | 1.18 |
| T 30 | 78.9 | 119.8 | 18.6 | 6.4 | 6.5 | 5.2 | 1.25 | 19300 | 42200 | 2.2 | 65.0 | 1.19 |
| T 31 | 78.0 | 210.0 | 25.0 | 8.4 | 6.5 | 5.3 | 1.23 | 18500 | 43000 | 2.3 | 65.0 | 1.19 |
| T 32 | 85.0 | 280.6 | 29.3 | 9.6 | 6.7 | 5.5 | 1.22 | 19500 | 41800 | 2.1 | 65.0 | 1.18 |
| T 33 | 84.2 | 157.9 | 24.0 | 6.6 | 6.3 | 5.2 | 1.21 | 19500 | 42000 | 2.2 | 65.0 | 1.19 |

TABLE 7-continued

| | T(5) | t(1) | t(5) | t(1)/ | Toner particle size and particle size distribution D4 | D1 | | Molecular weight of THF-soluble matter of toner | | | Peak temperature Tp of maximum endothermic | True density ρ of toner |
|---|---|---|---|---|---|---|---|---|---|---|---|---|
| | [° C.] | [s] | [s] | t(5) | [μm] | μm] | D4/D1 | Mn | Mw | Mw/Mn | peak of toner [° C.] | [g/cm$^3$] |
| T 34 | 84.6 | 218.0 | 28.0 | 7.8 | 6.5 | 5.1 | 1.27 | 19000 | 43200 | 2.3 | 65.0 | 1.18 |
| T 35 | 70.0 | 90.0 | 20.7 | 4.3 | 6.5 | 5.5 | 1.18 | 19300 | 41500 | 2.2 | 65.0 | 1.19 |
| T 36 | 73.0 | 59.0 | 14.0 | 4.2 | 6.4 | 5.6 | 1.14 | 19800 | 41800 | 2.1 | 65.0 | 1.20 |
| T 37 | 95.2 | 188.3 | 28.0 | 6.7 | 8.1 | 5.7 | 1.42 | 19600 | 42100 | 2.1 | 65.0 | 1.16 |
| T 38 | 92.8 | 142.7 | 24.9 | 5.7 | 6.5 | 5.1 | 1.27 | 19400 | 41200 | 2.1 | 65.0 | 1.17 |
| T 39 | 73.0 | 59.0 | 15.0 | 3.9 | 6.6 | 5.3 | 1.25 | 22400 | 46500 | 2.1 | 65.0 | 1.19 |
| T 40 | 177.0 | 745.6 | 182.4 | 4.1 | 6.7 | 5.2 | 1.29 | 23400 | 47500 | 2.0 | 65.0 | 1.19 |
| T 41 | 92.0 | 214.2 | 21.0 | 10.2 | 6.5 | 5.1 | 1.27 | 20400 | 43000 | 2.1 | 65.0 | 1.18 |
| T 42 | 111.0 | 8800.0 | 1746.0 | 5.0 | 6.7 | 5.1 | 1.31 | 23400 | 47500 | 2.0 | — | 1.19 |
| T 43 | 82.0 | 52.0 | 24.0 | 2.2 | 6.5 | 5.0 | 1.30 | 23400 | 47500 | 2.0 | 65.0 | 1.18 |
| T 44 | 74.0 | 55.0 | 22.0 | 2.5 | 6.6 | 5.1 | 1.29 | 23400 | 47500 | 2.0 | 65.0 | 1.19 |
| T 45 | 74.0 | 25.0 | 19.0 | 1.3 | 6.4 | 5.2 | 1.23 | 23400 | 47500 | 2.0 | 65.0 | 1.15 |
| T 46 | 64.7 | 59.4 | 5.7 | 10.4 | 6.6 | 5.1 | 1.29 | 19600 | 41000 | 2.1 | 58.0 | 1.16 |
| T 47 | 91.0 | 322.2 | 32.1 | 10.0 | 6.5 | 5.0 | 1.30 | 19400 | 41200 | 2.1 | 65.0 | 1.17 |
| T 48 | 60.0 | 10.0 | 2.0 | 5.0 | 6.3 | 4.9 | 1.29 | 23400 | 47500 | 2.0 | 65.0 | 1.18 |

"T" in the leftmost column represents Toner.

Note that the glass transition temperature of the toner 42 was 63.0° C.

TABLE 8

| | | | Stress resistance | | Chargeability | | |
|---|---|---|---|---|---|---|---|
| | Toner | Low-temperature fixability (fixing start temperature [° C.] is described in parentheses) | Evaluation of image streaks in 8000 sheet continuous durability test (the number of development streaks is described in parentheses) Temperature: 30.0° C. Relative humidity: 50% | Temperature: 32.5° C. Relative humidity: 50% | Evaluation of ratio of decrease in triboelectrification amount (ratio of decrease in triboelectrification amount [%] is described in parentheses) | Triboelectrification amount after shaking for a minute [mC/kg] | Triboelectrification amount after shaking for 30 minutes [mC/kg] |
| E 1 | T 1 | A(90) | A(0) | A(0) | A(5) | −30.0 | −28.5 |
| E 2 | T 2 | A(95) | A(0) | A(0) | A(5) | −30.0 | −28.5 |
| E 3 | T 3 | C(110) | A(0) | B(1) | A(8) | −30.0 | −27.6 |
| E 4 | T 4 | A(95) | B(2) | C(3) | B(13) | −30.0 | −26.1 |
| E 5 | T 5 | B(105) | C(3) | C(3) | B(14) | −30.0 | −25.8 |
| E 6 | T 6 | C(110) | A(0) | B(1) | B(10) | −30.0 | −27.0 |
| E 7 | T 7 | C(115) | A(0) | B(2) | B(13) | −30.0 | −26.1 |
| E 8 | T 8 | C(110) | B(2) | B(2) | B(10) | −40.0 | −36.0 |
| E 9 | T 9 | C(110) | A(0) | B(2) | A(8) | −25.0 | −23.0 |
| E 10 | T 10 | C(115) | C(3) | C(4) | B(13) | −40.0 | −34.8 |
| E 11 | T 11 | C(115) | B(2) | C(3) | B(12) | −40.0 | −35.2 |
| E 12 | T 12 | C(110) | B(2) | B(2) | B(10) | −24.0 | −21.6 |
| E 13 | T 13 | C(110) | B(1) | B(1) | B(12) | −35.0 | −30.8 |
| E 14 | T 14 | A(90) | B(1) | B(2) | B(10) | −26.7 | −24.0 |
| E 15 | T 15 | C(110) | A(0) | A(0) | A(5) | −33.3 | −31.7 |
| E 16 | T 16 | C(115) | B(2) | C(3) | A(9) | −24.0 | −21.8 |
| E 17 | T 17 | B(100) | A(0) | B(1) | A(8) | −30.0 | −27.6 |
| E 18 | T 18 | C(110) | A(0) | A(0) | A(5) | −24.0 | −22.8 |
| E 19 | T 19 | C(115) | A(0) | B(2) | A(7) | −30.0 | −27.9 |
| E 20 | T 20 | A(85) | B(2) | C(3) | B(11) | −24.0 | −21.4 |
| E 21 | T 21 | A(90) | C(5) | C(5) | B(14) | −23.3 | −20.1 |
| E 22 | T 22 | C(115) | A(0) | C(3) | B(11) | −46.7 | −41.5 |
| E 23 | T 23 | C(115) | B(2) | C(3) | B(10) | −23.3 | −21.0 |
| E 24 | T 24 | B(105) | B(2) | C(3) | B(11) | −33.3 | −29.7 |
| E 25 | T 25 | C(115) | C(3) | C(4) | B(13) | −22.7 | −19.7 |
| E 26 | T 26 | C(115) | C(4) | C(5) | B(14) | −34.0 | −29.2 |
| E 27 | T 27 | A(90) | C(6) | C(6) | B(14) | −24.3 | −20.9 |
| E 28 | T 28 | C(110) | A(0) | B(1) | A(5) | −41.4 | −39.4 |
| E 29 | T 29 | A(95) | C(3) | C(4) | B(14) | −20.0 | −17.2 |
| E 30 | T 30 | A(90) | B(2) | C(3) | B(12) | −12.0 | −10.6 |
| E 31 | T 31 | C(110) | C(4) | C(5) | B(14) | −30.0 | −25.8 |
| E 32 | T 32 | C(110) | A(0) | A(0) | A(5) | −33.3 | −31.7 |
| E 33 | T 33 | B(105) | C(4) | C(5) | B(14) | −22.7 | −19.5 |
| E 34 | T 34 | C(115) | A(0) | A(0) | B(14) | −41.3 | −35.5 |
| CE 1 | T 35 | A(90) | C(6) | D(8) | C(15) | −30.0 | −25.5 |
| CE 2 | T 36 | B(105) | C(6) | D(9) | D(20) | −40.0 | −32.0 |
| CE 3 | T 37 | D(120) | C(6) | D(8) | C(15) | −23.3 | −19.8 |

TABLE 8-continued

| | | | Stress resistance | | Chargeability | | |
|---|---|---|---|---|---|---|---|
| | | Low-temperature fixability (fixing start | Evaluation of image streaks in 8000 sheet continuous durability test (the number of development streaks is described in parentheses) | | Evaluation of ratio of decrease in triboelectrification amount (ratio of decrease in | Triboelectrification amount | Triboelectrification amount |
| | Toner | temperature [° C.] is described in parentheses) | Temperature: 30.0° C. Relative humidity: 50% | Temperature: 32.5° C. Relative humidity: 50% | triboelectrification amount [%] is described in parentheses) | after shaking for a minute [mC/kg] | after shaking for 30 minutes [mC/kg] |
| CE 4 | T 38 | D(120) | C(6) | D(8) | C(15) | −54.7 | −46.5 |
| CE 5 | T 39 | B(105) | C(6) | D(7) | D(20) | −30.0 | −24.0 |
| CE 6 | T 40 | D(130) | B(1) | B(1) | B(10) | −24.0 | −21.6 |
| CE 7 | T 41 | D(125) | A(0) | A(0) | C(15) | −32.0 | −27.2 |
| CE 8 | T 42 | D(130) | C(4) | C(5) | D(22) | −32.0 | −25.0 |
| CE 9 | T 43 | A(95) | D(10) | D(11) | D(22) | −30.0 | −23.4 |
| CE 10 | T 44 | A(90) | D(11) | D(12) | D(25) | −30.0 | −22.5 |
| CE 11 | T 45 | A(90) | D(11) | D(12) | D(25) | −30.0 | −22.5 |
| RE 1 | T 46 | D(120) | A(0) | A(0) | A(7) | −30.0 | −27.9 |
| RE 2 | T 47 | D(120) | A(0) | A(0) | A(7) | −33.3 | −31.0 |
| RE 3 | T 48 | A(80) | D(7) | D(10) | C(18) | −30.0 | −24.6 |

"E" in the leftmost column represents Example.
"CE" in the leftmost column represents Comparative example.
"RE" in the leftmost column represents Reference example.
"T" in the second leftmost column represents Toner.

The present invention can provide a toner having both low-temperature fixability and stress resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2012/064315, filed Jun. 1, 2012, which is hereby incorporated by reference herein in its entirety.

The invention claimed is:

1. A toner comprising toner particles, each of which contains a binder resin and a colorant, wherein the toner particles have a core-shell structure in which a shell phase containing a resin B is formed on a surface of a core containing a binder resin A, a colorant, and a wax, the binder resin A contains a resin having a polyester segment capable of forming a crystalline structure, the resin B contains a resin having a polyester segment capable of forming a crystalline structure, and a content of the polyester segment capable of forming a crystalline structure in the binder resin A is 50.0% by mass or more and 90.0% by mass or less, wherein, in a rheological property measurement of the toner with a constant load extrusion-type capillary rheometer provided with a piston for applying a pressure to a sample and a die having a die orifice through which the sample is extruded, wherein the piston has a pressure-application surface area of 1.0 $cm^2$ and the die orifice has a diameter of 1.0 mm, when a pressure of 5.0 MPa is applied to the sample with the piston, a temperature at which a displacement of the piston reaches 2.0 mm after 10 seconds from initiation of an application of the pressure is defined as T(5);

when a pressure of 1.0 MPa is applied to the sample with the piston under heating at 70° C., a time over which a displacement of the piston reaches 2.0 mm from initiation of the pressure application is defined as t(1); and when a pressure of 5.0 MPa is applied to the sample with the piston under heating at 70° C., a time over which a displacement of the piston reaches 2.0 mm from initiation of the pressure application is defined as t(5), T(5) is 65.0° C. or more and 90.0° C. or less, t(1) is 60.0 seconds or more, t(5) is 30.0 seconds or less, and t(1)/t(5) is 4.5 or more and 10.0 or less.

2. The toner according to claim 1, wherein, in a measurement of the toner with a differential scanning calorimeter (DSC), a peak temperature Tp (° C.) of a maximum endothermic peak is 55.0° C. or more and 75.0° C. or less.

3. The toner according to claim 1, wherein the binder resin A contains a block polymer in which the polyester segment capable of forming a crystalline structure is chemically bonded to a segment not forming a crystalline structure.

4. The toner according to claim 3, wherein the segment not forming a crystalline structure is a urethane resin obtained by a reaction between a diol and a diisocyanate.

5. The toner according to claim 1, wherein the resin B is a vinyl-based resin obtained by copolymerization of a vinyl-based monomer b1 including in a molecular structure a polyester segment capable of forming a crystalline structure and another vinyl-based monomer b2.

6. The toner according to claim 5, wherein a proportion of the vinyl-based monomer b1 with respect to amounts of all monomers used for the copolymerization of the resin B is 20.0% by mass or more and 50.0% by mass or less.

7. The toner according to claim 5, wherein the vinyl-based monomer b2 contains a vinyl-based monomer x, the vinyl-based monomer x has, as a homopolymer, a glass transition temperature of 105° C. or more, and a proportion of the vinyl-based monomer x with respect to amounts of all monomers used for the copolymerization of the resin B is 3.0% by mass or more and 15.0% by mass or less.

8. The toner according to claim 5, wherein the vinyl-based monomer b2 contains a vinyl-based monomer y, the vinyl-based monomer y has an organic polysiloxane structure and a proportion of the vinyl-based monomer y with respect to amounts of all monomers used for the copolymerization of the resin B is 5.0% by mass or more and 20.0% by mass or less.

9. The toner according to claim 1, wherein, in the toner particles, a content of the resin B with respect to 100 parts by mass of the core is 3.0 parts by mass or more and 15.0 parts by mass or less.

10. The toner according to claim 1, wherein the toner particles are formed by (I) a step of obtaining a resin composition in which the binder resin and the colorant are dissolved or dispersed in a medium containing an organic solvent, (II) a step of obtaining a dispersion by dispersing the resin composition in a dispersion medium containing resin fine particles containing the resin B and carbon dioxide that is at a pressure of 1.0 MPa or more and 20.0 MPa or less and at a temperature of 10° C. or more and 40° C. or less, and (III) a step of removing the organic solvent from the dispersion.

11. A method for producing a toner in which toner particles are produced by (I) a step of obtaining a resin composition in which a binder resin and a colorant are dissolved or dispersed in a medium containing an organic solvent, (II) a step of obtaining a dispersion by dispersing the resin composition in a dispersion medium containing resin fine particles containing a resin B for forming a shell phase and carbon dioxide that is at a pressure of 1.0 MPa or more and 20.0 MPa or less and at a temperature of 10° C. or more and 40° C. or less, and (III) a step of removing the organic solvent from the dispersion, wherein the produced toner contains the toner particles, each of which contains the binder resin and the colorant, in a rheological property measurement of the toner with a constant load extrusion-type capillary rheometer provided with a piston for applying a pressure to a sample and a die having a die orifice through which the sample is extruded, wherein the piston has a pressure-application surface area of 1.0 $cm^2$ and the die orifice has a diameter of 1.0 mm, when a pressure of 5.0 MPa is applied to the sample with the piston, a temperature at which a displacement of the piston reaches 2.0 mm after 10 seconds from initiation of an application of the pressure is defined as T(5);

when a pressure of 1.0 MPa is applied to the sample with the piston under heating at 70° C., a time over which a displacement of the piston reaches 2.0 mm from initiation of the pressure application is defined as t(1); and when a pressure of 5.0 MPa is applied to the sample with the piston under heating at 70° C., a time over which a displacement of the piston reaches 2.0 mm from initiation of the pressure application is defined as t(5), T(5) is 65.0° C. or more and 90.0° C. or less, t(1) is 60.0 seconds or more, t(5) is 30.0 seconds or less, and t(1)/t(5) is 4.5 or more and 10.0 or less.

12. A toner comprising toner particles, each of which contains a binder resin and a colorant, wherein the toner particles have a core-shell structure in which a shell phase containing a resin B is formed on a surface of a core containing a binder resin A, a colorant, and a wax, the binder resin A contains a resin having a polyester segment capable of forming a crystalline structure, and a content of the polyester segment capable of forming a crystalline structure in the binder resin A is 50.0% by mass or more and 90.0% by mass or less, wherein, in a rheological property measurement of the toner with a constant load extrusion-type capillary rheometer provided with a piston for applying a pressure to a sample and a die having a die orifice through which the sample is extruded, wherein the piston has a pressure-application surface area of 1.0 $cm^2$ and the die orifice has a diameter of 1.0 mm, when a pressure of 5.0 MPa is applied to the sample with the piston, a temperature at which a displacement of the piston reaches 2.0 mm after 10 seconds from initiation of an application of the pressure is defined as T(5);

when a pressure of 1.0 MPa is applied to the sample with the piston under heating at 70° C., a time over which a displacement of the piston reaches 2.0 mm from initiation of the pressure application is defined as t(1); and when a pressure of 5.0 MPa is applied to the sample with the piston under heating at 70° C., a time over which a displacement of the piston reaches 2.0 mm from initiation of the pressure application is defined as t(5), T(5) is 65.0° C. or more and 90.0° C. or less, t(1) is 60.0 seconds or more, t(5) is 30.0 seconds or less, and t(1)/t(5) is 4.5 or more and 10.0 or less.

* * * * *